US005841462A

United States Patent [19]

Matsuo et al.

[11] Patent Number: 5,841,462

[45] Date of Patent: Nov. 24, 1998

[54] THERMAL TRANSFER PRINTING METHOD

[75] Inventors: Hiroyuki Matsuo, Neyagawa; Yasuo Fukui, Kadoma; Akihiro Imai; Nobuyoshi Taguchi, both of Ikoma; Atsushi Sogami, Sanda; Masanori Yoshikawa, Neyagawa, all of Japan

[73] Assignee: Matsushita Electric Industrial Co., Ltd.

[21] Appl. No.: 730,316

[22] Filed: Oct. 11, 1996

Related U.S. Application Data

[63] Continuation of Ser. No. 297,300, Aug. 29, 1994, abandoned.

[30] Foreign Application Priority Data

Sep. 1, 1993 [JP] Japan ..... 5-217276

[51] Int. Cl.[6] ..... B41J 2/325

[52] U.S. Cl. ..... 347/213

[58] Field of Search ..... 347/213; 503/227

[56] References Cited

U.S. PATENT DOCUMENTS 4,743,920 5/1988 Tohma et al. .

5,284,814 2/1994 Taguchi et al. ..... 347/213

5,398,051 3/1995 Fukui et al. ..... 347/213

FOREIGN PATENT DOCUMENTS 029 313 5/1981 European Pat. Off. .

57-187274 11/1982 Japan .

4-141486 5/1992 Japan .

*Primary Examiner*—Huan H. Tran

*Attorney, Agent, or Firm*—Morrison & Foerster LLP

[57] ABSTRACT

A thermal transfer printing method using a color developing layer transfer sheet having color developing layer at least on either side of its substrate, a dye layer transfer sheet having at least on either side of its substrate and an intermediate medium and including the steps of first transferring partly or entirely the color developing layers on the color developing layer transfer sheet onto the intermediate medium by means of heat and/or pressure as color developing layer transfer means, then laying the color developing layer and the dye layer one upon the other and causing the dye to migrate to the color developing layer on the intermediate medium by means of heat and pressure for formation of pictorial image thereon and further transferring the formed pictorial image from the intermediate medium onto the color receiving sheet again by means of heat and pressure.

24 Claims, 13 Drawing Sheets

FIG.7 (A)
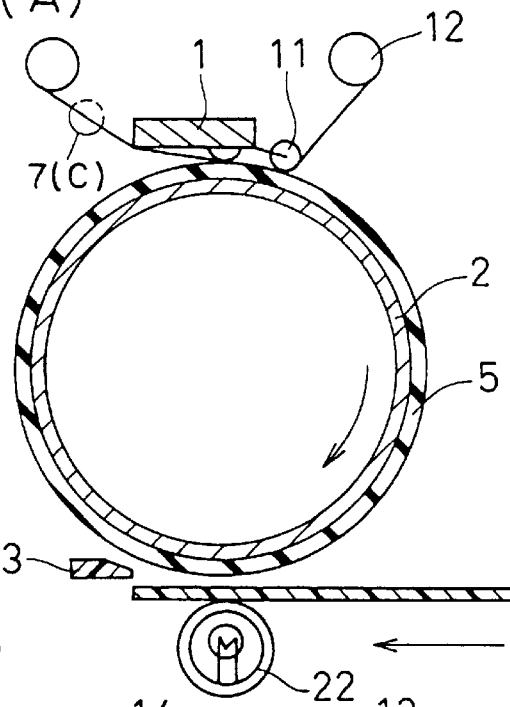
FIG. 7(D)
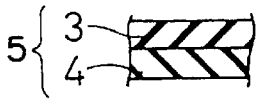
FIG. 7(C)
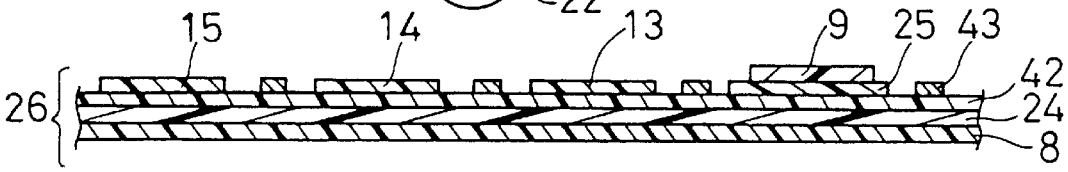
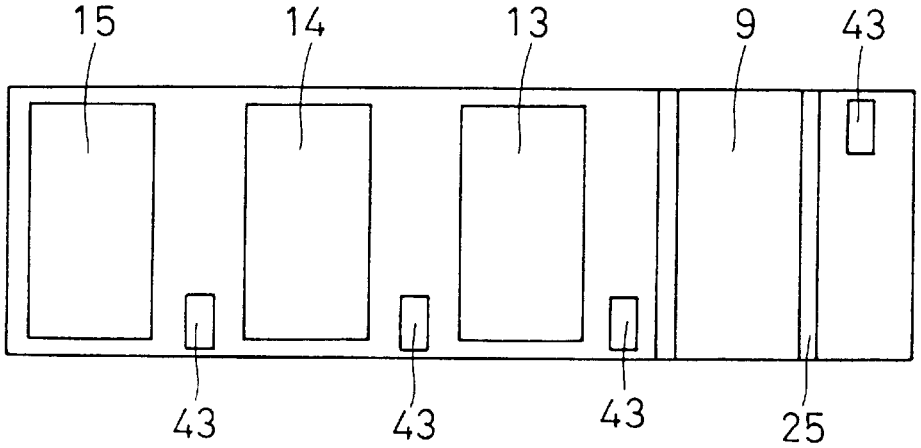
FIG.7 (B)

FIG. 8 (A)
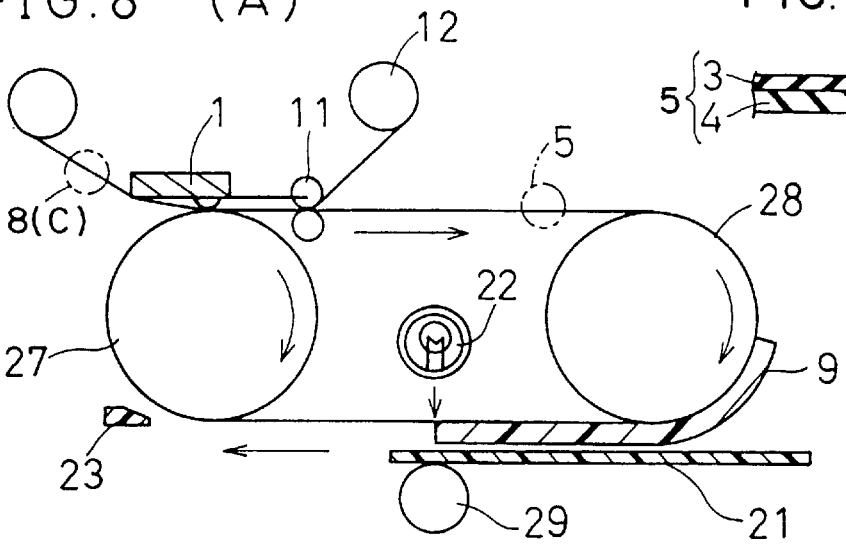
FIG. 8(D)
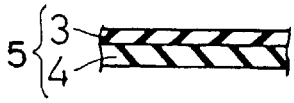
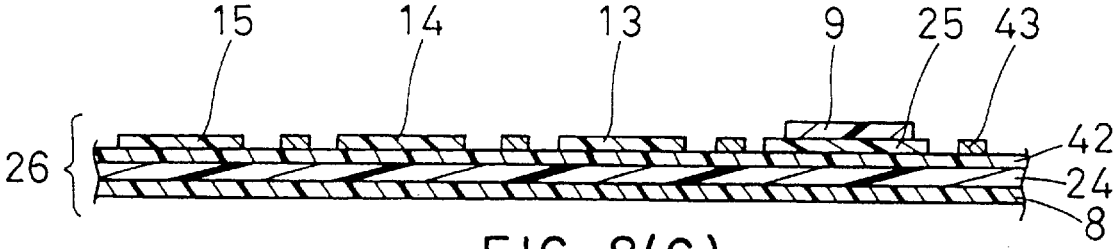
FIG. 8(C)
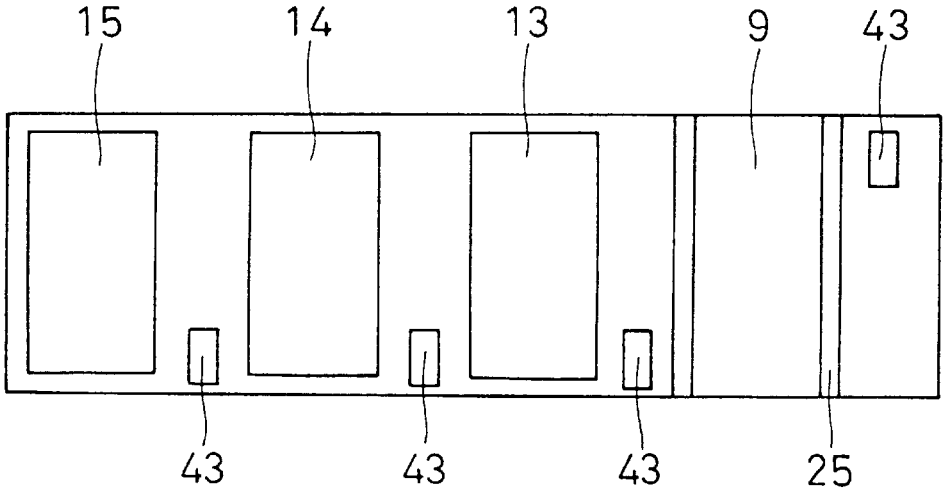
FIG. 8 (B)

THERMAL TRANSFER PRINTING METHOD

This application is a continuation of U.S. application Ser. No. 08/297,300 filed Aug. 29, 1994, now abandoned.

FIELD OF THE INVENTION

This invention relates to a method of thermal transfer printing on color receiving sheets such as post cards, ordinary paper and bond paper so as to avoid using exclusive color receiving sheets pre-coated to have a color developing layer on its surface. The transfer printing of the method of thermal transfer printing of the sublimation type uses the principle that pigments sublimate or diffuse when they are subjected to heat.

BACKGROUND OF THE INVENTION

Methods of outputting mono-color or full-color picture images simply and quickly without using general typing or printing include an ink jet method and thermal transfer printing method. A sublimation type thermal transfer printing method using an an exclusive color receiving sheet pre-coated for formation of a color developing layer thereon is considered the best method of outputting full-color pictorial images and features excellent continuous gradient and compares well to true full color photographs. Quite naturally this thermal transfer printing method spread quickly but in time there has been a growing desire for a method of attaining an equally excellent image quality on ordinary non-exclusive sheets generally used at home and office such as post cards, ordinary paper, bond paper and dull art papers. To meet this growing desire, the following thermal transfer printing method has been proposed.

FIG. 12 is a schematic diagram showing the method in use and reference numeral 31 represents a transfer sheet. The transfer sheet 31 has on one side of its transfer substrate 33 (made of, for example, polyester film) a heat-resisting and slipping layer 32 and on the other side a color developing layer 34, yellow dye layer 35, magenta dye layer 36 and cyan dye layer 37 are provided one upon another in this order. Reference numeral 38 represents a thermal head, 39 a platen roller, 40 a color receiving sheet such as a post card or ordinary paper and a conveying roller 41 for conveying color receiving sheet 40.

First, the working principle of this method will be explained below with reference to FIGS. 13(A) or (B). As shown in FIG. 13(A), the transfer sheet 31 and the color receiving sheet 40 are inserted between the thermal head 38 and the platen roller 39 to bring the color developing layer 34 into contact with the color receiving sheet. Then, the platen roller 39 is rotated and the transfer sheet 31 and the color receiving sheet 40 are conveyed in the direction indicated by the arrow. The thermal head 38 is heated from behind the heat-resisting and slipping layer 32 so as to melt the color developing layer 34 all-over. Since the color developing layer 34 is then molten and bonded all-over to the color receiving sheet 40, the color developing layer 34 is transferred thereto. Then the color receiving sheet 40 with the color developing layer 34 transferred thereto is brought back and then, as shown in FIG. 13(B), the transfer sheet 31 and the color receiving sheet 40 are set between the thermal head 38 and the platen roller 39 so that the yellow dye layer 35 and the color developing layer 34 come into contact. Then the platen roller 39 is rotated and, with the transfer sheet 31 and the color receiving sheet 40 being conveyed in the direction indicated by the arrow, the thermal head 38 is heated from behind the heat-resisting and slipping layer 32 for the yellow dye to migrate from the yellow dye layer 35 to the color developing layer 34 for a yellow pictorial image to be recorded. The magenta and cyan dyes are likewise caused to migrate for recording pictorial images in the respective colors, and finally a full color pictorial image is recorded in the color developing layer 34 on the color receiving sheet 40.

By the sublimation type thermal transfer printing method described above recording is done by color migration from a dye layer to a color developing layer 34 as the dye layer is heated. Hence, if the dye layer and the color developing layer are not contacted evenly, density unevenness and dye migration failure will result, which tends to cause undergrounding of the pictorial image. When the color receiving sheet 40 is a post card, ordinary paper or bond paper, there is unevenness in the surface due to paper fibers. The aforementioned sublimation-type thermal transfer printing method has a drawback of fiber-induced surface unevenness, or roughness is copied on the color developing layer surface, which results in a failure of uniform contact between the dye layer and the dyeing layer, which often badly affects the picture quality due to density unevenness or minute unrecorded spots.

SUMMARY OF THE INVENTION

An object of the invention is to provide a thermal transfer printing method for stabilizing a high-quality pictorial image using a color receiving sheet such as a post card, bond paper and overhead projector ("OHP" hereinafter) film.

In order to accomplish these and other objects and advantages, a thermal transfer printing method of this invention comprising the steps of forming at least one developing layer on a color developing layer transfer sheet having a dye layer thereon partly or wholly by heat and pressure, then laying at least one color developing layer and the dye layer on an intermediate medium and forming a recorded image thereon with heat and pressure as recording means to migrate dyes from the dye layers to the color developing layers and thereafter transferring the color developing layer from the intermediate medium to a color receiving sheet, by the use of heat and pressure as transfer means wherein before separating the color developing layer transfer sheet from the intermediate medium both of them are cooled so that the adhesive force between the intermediate medium and the color developing layer is greater than the adhesive force between the color developing layer substrate and the color developing layer.

While in the prior art a high-quality pictorial image could not be produced unless an expensive special pre-coated color receiving sheet was used, the method of the invention enables transfer of high-quality pictorial images stably on a post card, ordinary paper, bond paper, OHP film and the like.

BRIEF DESCRIPTION OF THE DRAWINGS

FIGS. 7(A) and (B) are schematic diagrams showing the thermal transfer printing method in an embodiment of the invention, wherein FIG. 7(C) is an enlarged sectional view of the transfer sheet and FIG. 7(D) is a plan view of the same.

FIGS. 8(A) and (B) are schematic diagrams showing the thermal transfer printing method in an embodiment of the invention, wherein FIG. 8(C) is an enlarged sectional view of part of the transfer sheet and FIG. 8(D) is its plan view.

DESCRIPTION OF THE PREFERRED EMBODIMENT

Figure 1:
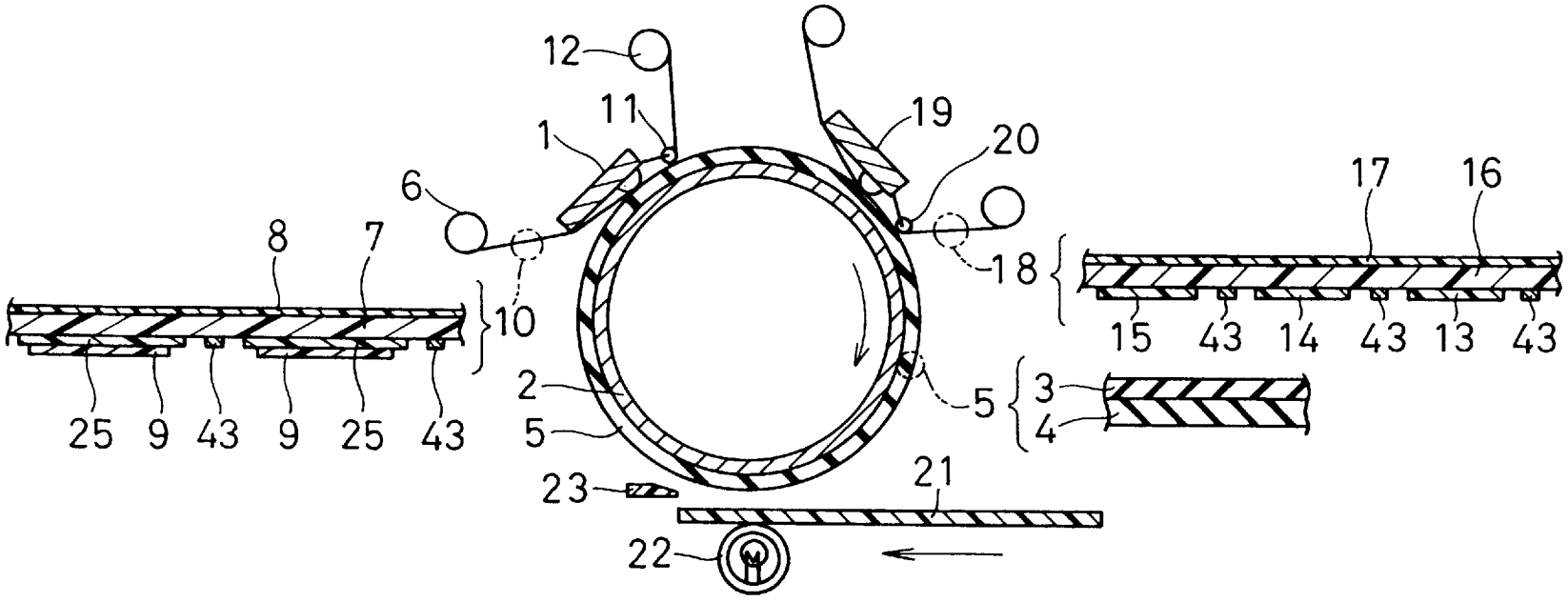
FIG. 1 is a schematic diagram showing the thermal transfer printing method in an embodiment of the invention.

FIG. 1 is a schematic diagram showing the thermal transfer printing method in an embodiment of the invention, which will now be described in detail. At the center of the equipment for executing the thermal transfer printing method there is disposed a supporting drum 2 made of a metal such as aluminum, which rotates in the direction indicated by the arrow. The supporting drum 2 has wound thereon an intermediate medium 5. Around the supporting drum 2 there are disposed a thermal head 1 as "color developing layer transfer means", another thermal head 19 as recording means, heat roll 22 and color receiving sheet separating nail 23. The color developing layer transfer means 1 has attached thereto a color developing layer cooling roller 11 to contact with an intermediate medium 5. Similarly the recording means 19 has attached thereto a dye layer cooling roller 20 to contact with the intermediate medium 5. Between the recording means 19 and the intermediate medium 5 there is set the dye layer transfer sheet 18. The intermediate medium is composed of at least a surface layer 3 and an intermediate transfer substrate 4. The color developing layer transfer sheet 10 comprises a heat-resisting and slipping layer 8 on one side of a color developing layer substrate 7, and a marker 43, a patterned release layer 25 and a color developing layer 9 on the other side thereof. The dye layer transfer sheet 18 comprises a heat-resisting and slipping layer 17 on one side of a dye layer substrate 16 and a marker 43, patterned yellow dye layer 13, magenta dye layer 14 and cyan dye layer 15 on the other side thereof. The color receiving sheet 21 is held between the heat roll 22 and the intermediate medium 5 and moves in the direction indicated by the arrow. For separation of the intermediate medium 5 from the color receiving sheet 21 may be used, if necessary, the color receiving sheet separating nail 23 may be used.

Figure 2:
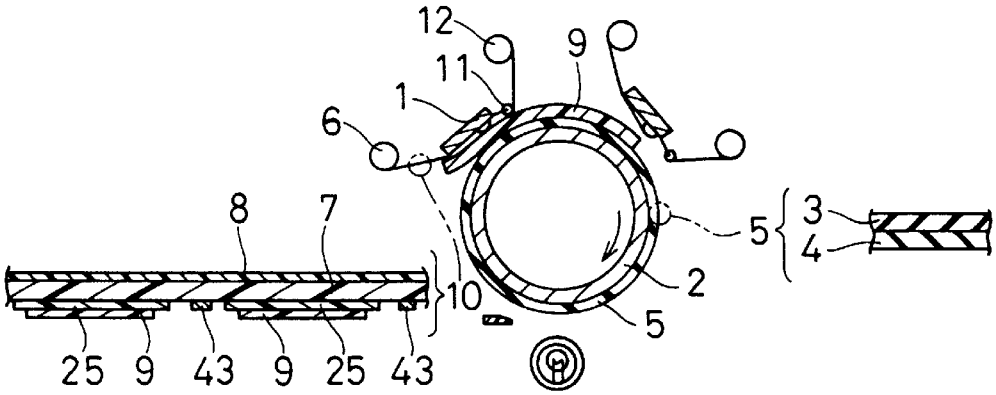
FIGS. 2(A)–(C) are views showing the operation of the thermal transfer printing method in an embodiment of the invention.
Figure 2:
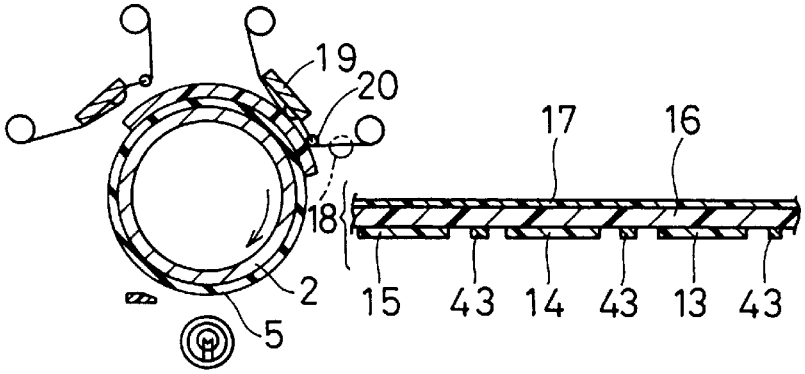
Figure 2:
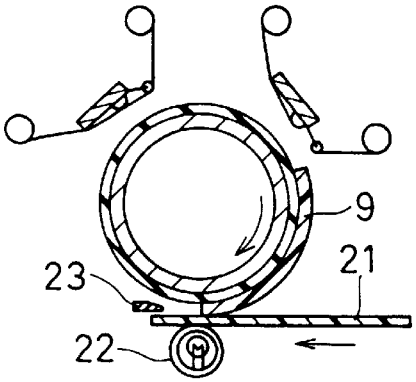
Figure 3:
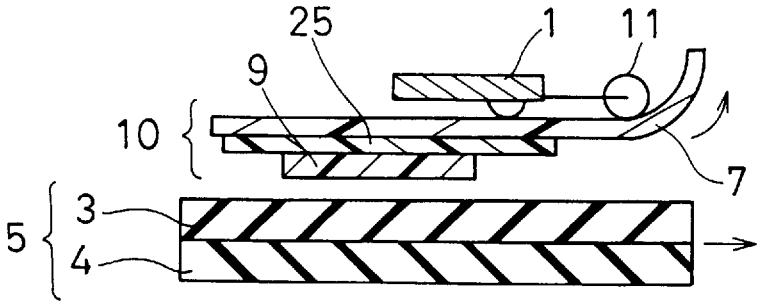
FIGS. 3(A)–(D) are detail views showing the color developing layer formation process in an embodiment of the invention.
Figure 3:
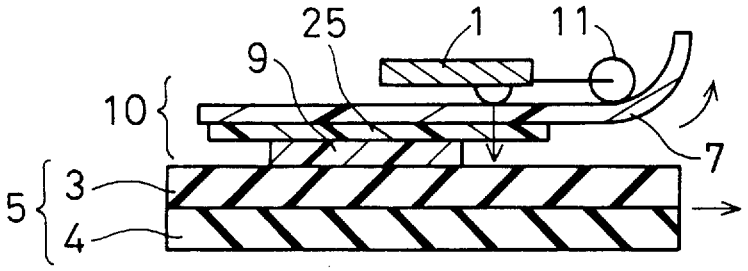
Figure 3:
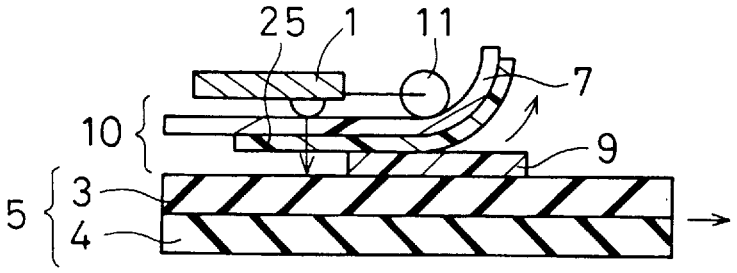
Figure 3:
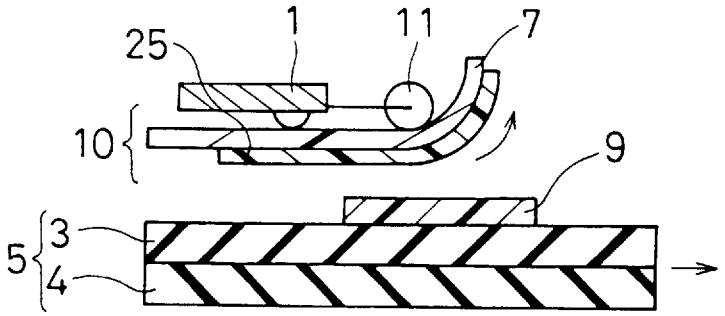

Now the principle of the invention will be described with reference to a FIGS. 2(A)–(C). First, as shown in FIG. 2(A), the color developing layer transfer sheet 10 is set between the thermal head 1 of the color developing transfer means so that the color developing layer 9 is in contact with the surface layer 3 and, with the supporting drum 2 being rotated in the direction indicated by the arrow, the thermal head 1 is heated by an energy source to soften the color developing layer 9 partly or entirely and a part or whole of the color developing layer 9 is transferred from the color developing layer transfer sheet onto the surface layer 3. This step is hereinafter called color the developing layer formation process. As to this color developing layer formation process, detailed explanation will be made below with reference to FIGS. 3(A)–(D), a view showing the operation of the method of the invention. First, as shown in FIG. 3(A), position matching is done so that the release layer 25 is positioned under the heating element of the thermal head 1, with the color developing layer transfer sheet 10 being wound by the winding roller 12. Next, as shown in FIG. 3(B), the thermal head 1 is pressed against the surface layer 3 and then heated and, the supporting drum 2 is driven so that, with the color developing layer transfer sheet 10 being wound up by the winding roller 12, the color developing layer 9 is formed on the surface layer 3. The domain heated by the thermal head 1 is adjusted so that, as seen from FIG. 4(C) (44=fine particles), it is larger than the size of the color developing layer 9 and smaller than the size of the release layer 25. By so doing, the heat and pressure of the thermal head 1 prevent the color developing layer substrate 7 from firmly sticking to the surface layer 3 and the color developing later transfer sheet 10 is wound by the winding roller 12.

Figure 4:
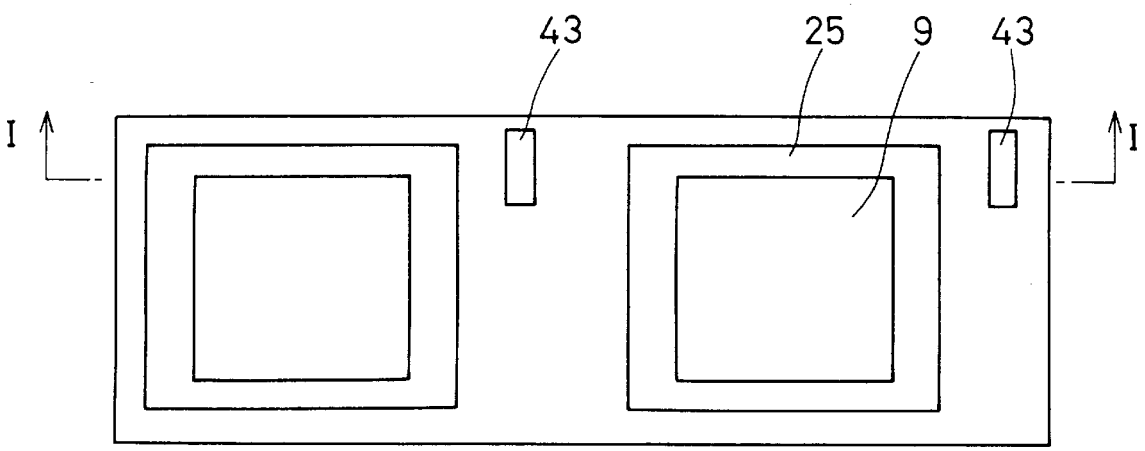
FIGS. 4(A)–(C) are schematic diagrams showing the color developing layer transfer sheet in an embodiment of the invention.
Figure 4:
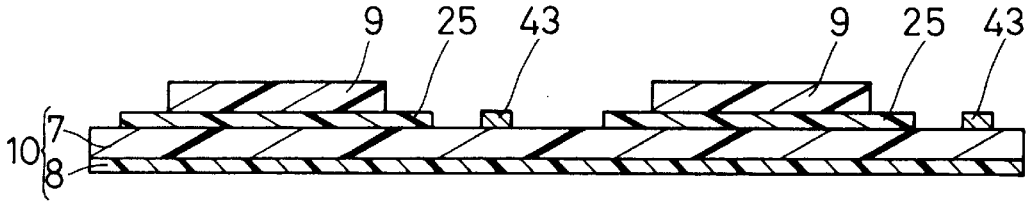
Figure 4:
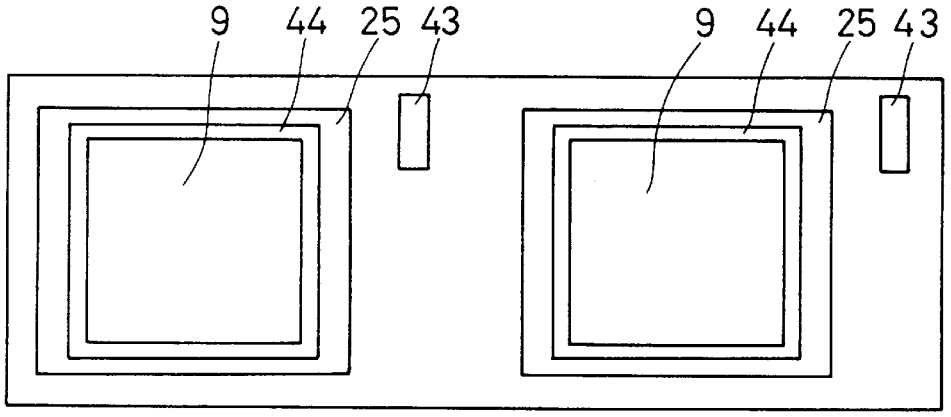
Figure 5:
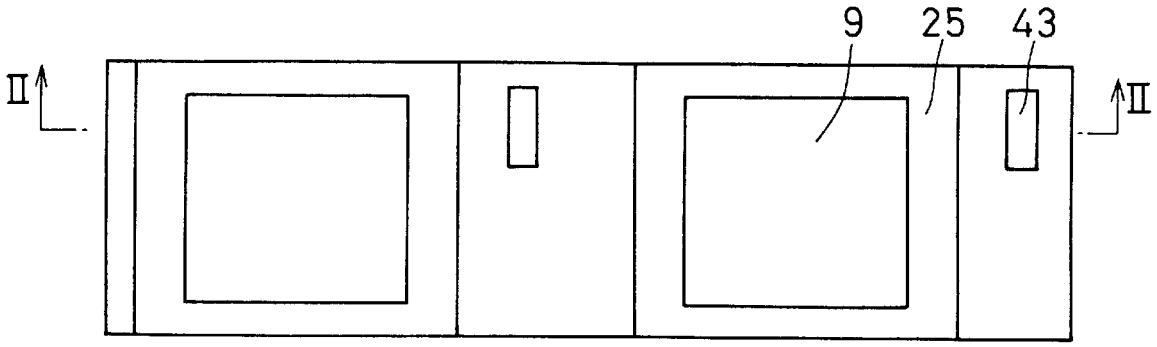
FIGS. 5(A)–(E) are schematic diagrams showing the color developing layer transfer sheet in an embodiment of the invention.
Figure 5:
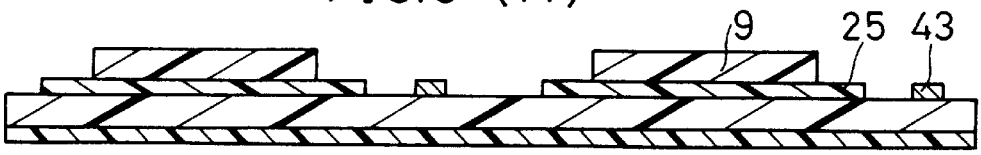
Figure 5:
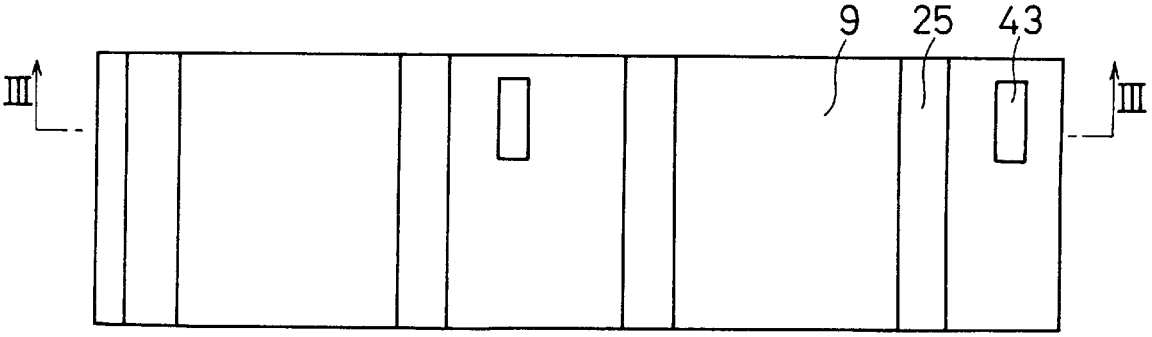
Figure 5:
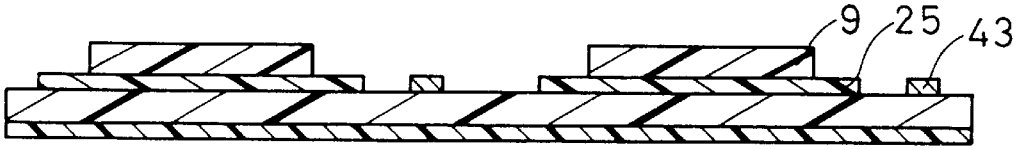
Figure 5:
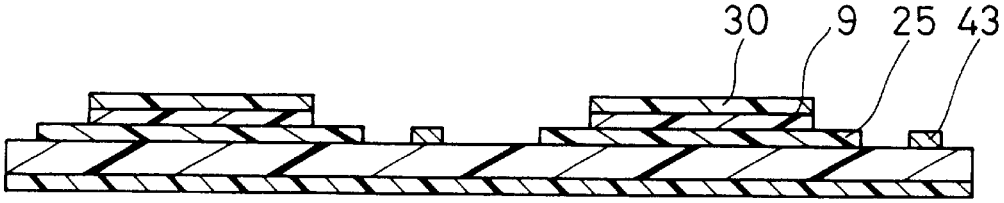

When the color developing layer transfer sheet 10 of the composition shown in FIG. 4(A) is used, the pressure of the thermal head 1 alone is enough to cause the color developing layer substrate 7 to stick somewhat to the surface layer 3, which is made of rubber, even by the pressure applied by the thermal head 1. Thus, there is a risk of the color developing layer substrate 7 on both sides of the color developing layer 9 sticking to the surface layer 3 and a sort of peeling sound results when the color developing layer substrate 7 is separated from the surface layer 3. FIG. 4(B) is a sectional view taken along the line I—I of FIG. 4(A). Hence, it is preferable to make the width of the release layer 25 equal to that of the color developing layer transfer sheet 10, as seen from FIG. 5(A), and eliminate the color developing layer substrate portions on both sides to make the color developing transfer sheet thinner. FIG. 5(B) is a sectional view along the line II—II of FIG. 5(A).

Figure 11:
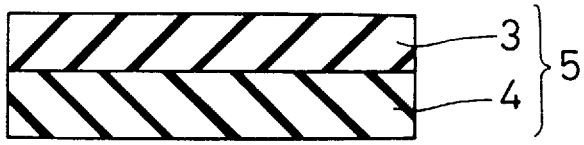
FIGS. 11(A)–(D) are schematic diagrams showing the intermediate medium.
Figure 11:
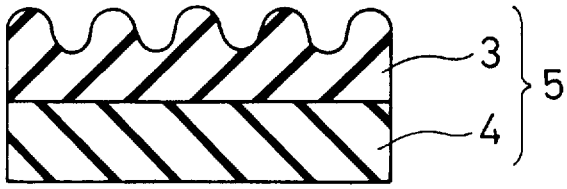
Figure 11:
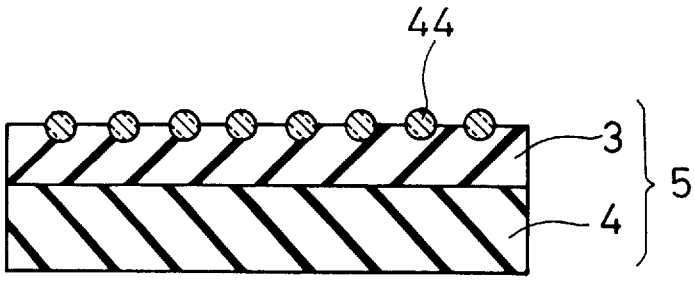
Figure 11:
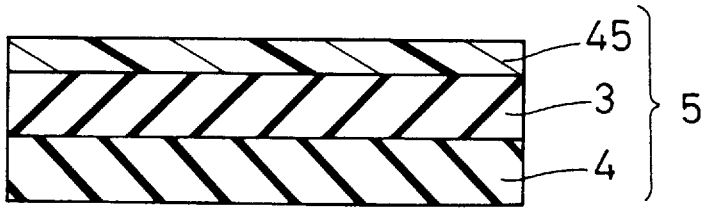
Figure 12:
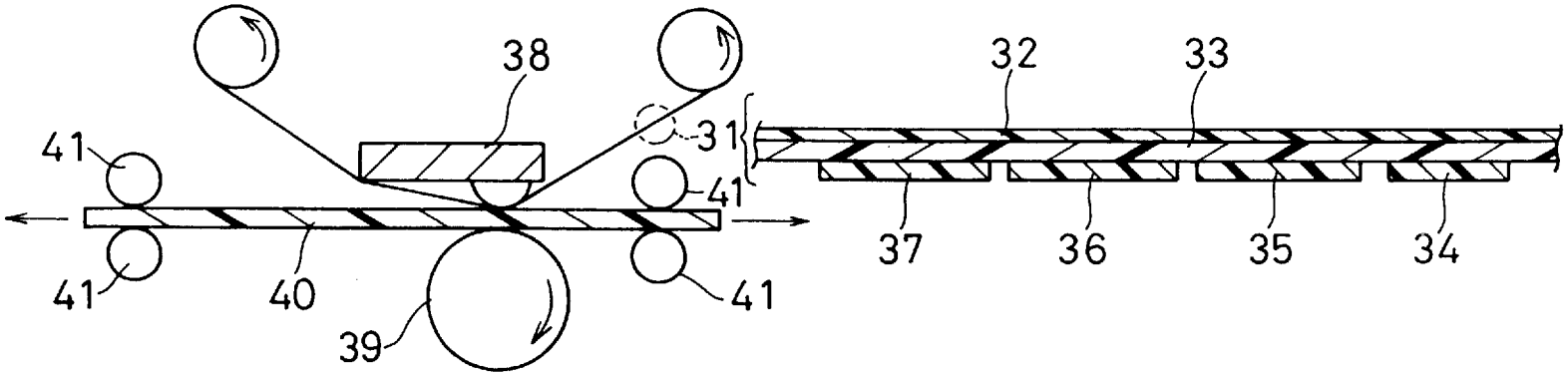
FIG.12 (PRIOR ART)
FIG. 12 is a schematic diagram showing a conventional thermal transfer printing method (prior art).
Figure 13:
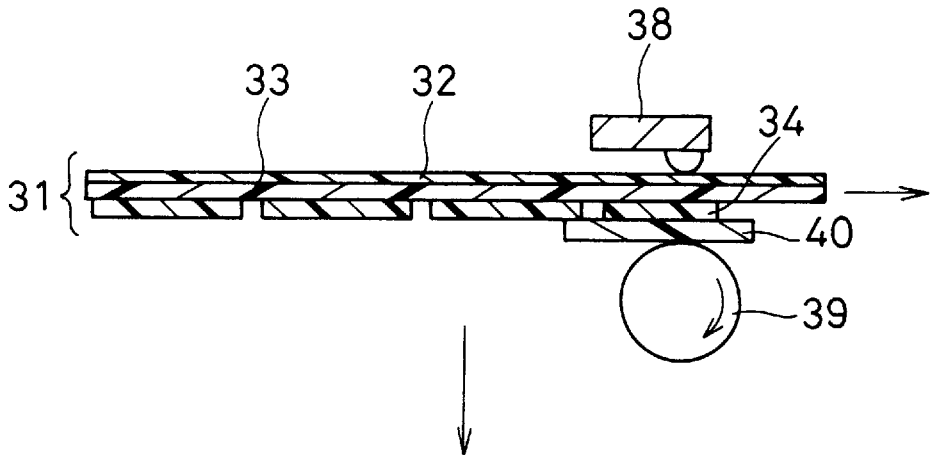
FIG.13 (A) (PRIOR ART)
FIGS. 13(A) and (B) are views showing the operation of the conventional thermal transfer printing method.
Figure 13:
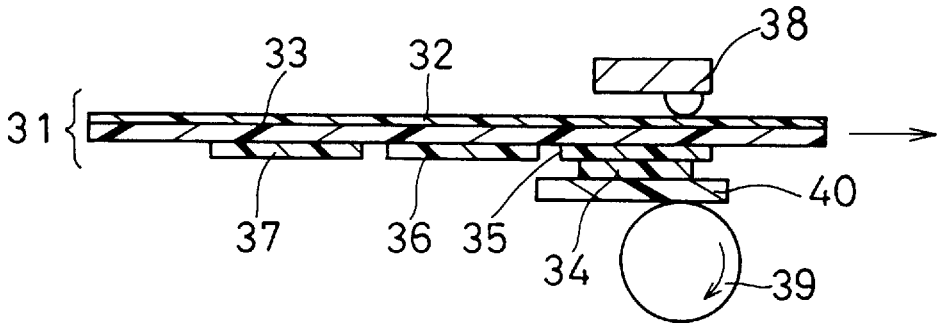
FIG.13 (B) (PRIOR ART)

Also, when the release layer 25 made of silicone rubber or the like, which easily sticks to the surface layer 3, is used, it is sometimes the case that the color developing layer 9 on the surface layer creases. This is because, where the color developing layer 9 is formed, elongation takes place due to the heat and friction of the thermal head 1. Where the release layer 25 is formed elongation does not take place due to sticking to the surface layer 3. Hence, when the rubber-like material of the release layer 25 is sticky to the surface layer 3, it is advisable to use the color developing layer transfer sheet 10 whose width is equal to that of the color developing layer 9, as shown in FIG. 5(C). FIG. 5(D) is a sectional view taken along the line III—III of FIG. 5(C). Creasing of the color developing layer 9 may also be prevented by roughening the surface of the surface layer 3, as shown in FIG. 11(B). It is effective to ensure against sticking of the release layer 25 to the surface layer 3. Studies have been made about the surface condition of the surface layer 3 for preventing creasing of the color developing layer 9, and the result to date is that the glossiness of the surface layer 3 is less than 45 when measured with a glossimeter (Horiba Seisakusho, Ltd.: IG-320: JIS-Z 8741 Gs (60°)), preferably less than 40. When a thermal head with a partial glaze head is used as the color developing layer transfer means 1, it is particularly effective for preventing creasing of the color developing layer 9 to ensure against contact of the color developing layer transfer sheet 10 with the surface layer 3 behind the partial glaze portion (a portion close to the supply roller 6).

For sufficient adhesion of the color developing layer 9 to the surface layer 3 in the color developing layer formation process the quantity of heat imparted by the thermal head 1 to the color developing layer 9 may be as large as possible. If the color developing layer transfer sheet 10 is separated from the surface layer 3 at a temperature above the flow softening point of the bonding resin of the color developing layer 9, the color developing layer 9 cannot be well formed over the surface layer 3 due to the low film strength of the color developing layer 9 and resulting severance inside the color developing layer 9. Hence, the separation of the color developing transfer sheet 10 from the surface layer 3 should be set not immediately behind the thermal head 1 by means of the color developing layer cooling roller 11, but the position of the separation has to be somewhat displaced and cooling has to be continued until the temperature of color developing layer 9 is below the flow softening point of the bonding resin of the color developing layer 9. Hence, the distance between the thermal head 1 and the color developing layer cooling roller 11 should be as large as possible.

Regarding the color developing layer formation process, it should be noted that separation of the color developing layer transfer sheet 10 from the intermediate medium 5 is to be carried out after cooling the color developing layer transfer sheet 10 and the intermediate medium 5 to make the adhesive force between the intermediate medium 5 and the color developing layer 9 larger than that between the color developing layer transfer sheet 10 and the color developing layer 9, the reason being as follows. As the color developing layer substrate 7, a PET film 4.5 μm in thickness was used. On the lower side of a heat-resisting and slipping layer 8 composed of a known UV-ray cured resin, 1 μm, and on the other side of the color developing layer substrate 7 a color developing layer 9 composed of a patterned polyvinyl acetal resin (KS-10, Sekisui Chemical Co., Ltd.) was formed with a thickness of 3 μm and a color developing layer transfer sheet 10 was thus prepared. As the intermediate transfer substrate 4 of the intermediate medium 5 polyimide film 50 μm thick and as the surface layer 30 μm-thick fluorine rubber (Bitone B: Showa Denko-DuPont, Ltd.) was used respectively. The temperature-dependent variation of the adhesive force of the color developing layer substrate 7 and the color developing layer 9 is shown by the curve A of FIG. 6, while the temperature-dependent variation of adhesive force between the color developing layer 9 and the surface layer 3 is shown by the curve B of FIG. 6. The adhesive force between the color developing layer substrate 7 and the color developing layer 9 was measured in the following way. A commercially available adhesive cellophane tape 18 mm-wide and 6 μm thick was stuck to the color developing layer 9 on the color developing layer sheet 10. The test piece thus prepared was placed on a hot plate, the adhesive cellophane plate was pulled up perpendicularly (180°) at a rate of 10 mm/sec. and then the tension was measured. The adhesive force between the color developing layer 9 and the surface layer 3 was measured in the following way. The thermal head 1 was heated in advance to form a 19 mm-wide color developing layer 9 on a surface layer 3 (under the same conditions as specifically described in Example 3 below), commercially available adhesive cellophane tape 37 μm-thick and 18 mm-wide was stuck to the color developing layer 9, the specimen was placed on a hot plate, the adhesive cellophane tape was pulled up vertically (180°) at a rate of 10 mm/sec. and then the tension was measured.

Figure 6:
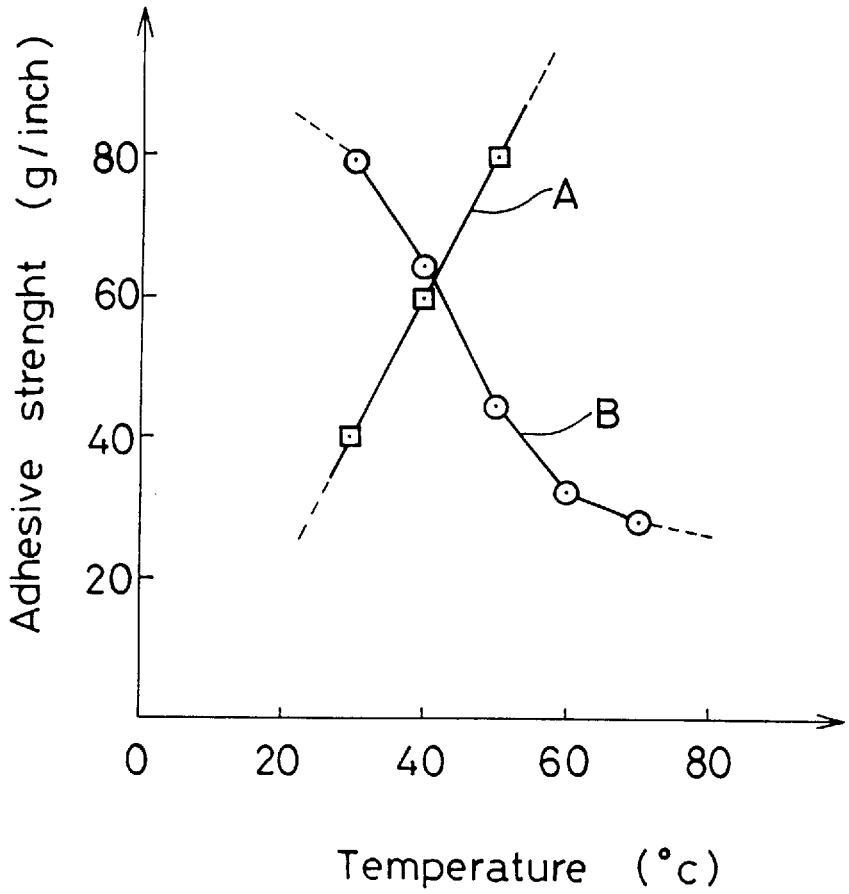
FIG. 6 is a diagram showing temperature-dependency of the adhesive force between the color developing layer and the color developing layer substrate and between the color developing layer and the intermediate medium.

From FIG. 6 it is apparent that adhesive force between the color developing layer 9 and the color developing layer substrate 7 increases with increasing temperature. Inversely, the adhesive force between the color developing substrate 9 and the surface layer 3 decreases with increasing temperature. For transferring the color developing layer 9 from the color developing layer substrate 7 onto the surface layer 3, therefore, the adhesive force between the color developing layer 9 and the surface layer 3 is required to be greater than the adhesive force between the color developing layer 9 and the color developing layer substrate 7. In other words, the transfer of the color developing layer 9 takes place at a temperature below the point of intersection between the curve A and curve B of FIG. 6. Hence, for separating the color developing layer transfer sheet 10 from the intermediate medium 5 it is required to cool both color developing layer transfer sheet 10 and intermediate medium 5 so as to make the adhesive force between the intermediate medium 5 and the color developing layer 9 greater than the adhesive force between the color developing layer transfer sheet 10 and the color developing layer 9 before separating the color developing layer transfer sheet 10 from the intermediate medium 5.

Then, as seen from FIG. 3(C), heating of the thermal head 1 should be stopped before the last end of the color developing layer 9 has passed the last end of the release layer 25 past the heater for the thermal head 1.

Finally, as seen from FIG. 3(D), the thermal head 1 is detached from where the release layer 25 is in contact with the surface layer 3, this being the last step of the color developing layer formation process. This way, the color developing layer 9 can be formed on the surface layer 3 stably and silently.

Next, as seen from FIG. 2(B), a dye layer transfer sheet 18 is held between the intermediate medium 5 and a thermal head "19" (1) as recording means 19 so that the color developing layer 9 on the surface layer 3 is in contact with a yellow dye layer 13, the thermal head 1 is heated for heating with a supporting drum 2 rotating in the direction indicated by the arrow and thereby a dye is caused to migrate from the yellow dye layer 13 to a color developing layer 9 for formation of a yellow pictorial image on the color developing layer 9. After migration of the yellow dye to the color developing layer 9 the yellow dye layer 13 is separated from the color developing layer 9 on the surface layer 3. Since the color developing layer 9 and the dye layer 13 are fused together immediately after being subjected to the heat of the thermal head 19, the binder resin of the color developing layer 9 is cooled to a temperature below the flow softening point of the bonding resin of the color developing layer 9 and the dye layer 13 is cooled to a temperature below the flow softening point of the bonding resin of the bonding resin of the brown dye layer 13 before separating the color developing layer 9 from the dye layer 13, this being important for relieving the burden resulting from fusion. The temperature when the color developing layer 9 is separated from the dye layer 13 should be as low as possible. Specifically, it is advisable to dispose the dye layer cooling roller 20 remotely from the thermal head 19 and separate the color developing layer 9 from the dye layer 13 after cooling to below the predetermined temperature. Hence, the distance between the thermal head 19 and the dye layer cooling roller 20 should be as great as possible, for the dye can then migrate stably from the dye layer 13 to the color developing layer 9 on the surface layer 3.

Also, it is sometimes the case during recording if the width of the layers 13–15 is greater than the width of the color developing layer 9, the both sides of the dye layers 13–15 are brought into contact with the surface layer to result in an increased migration of the dye from the dye layers 13 to 15 to the surface layer 3. The phenomenon of the dye accumulating on the surface layer 3 is remarkable if the recording is done repeatedly, hence the width of the dye layers 13 to 15 is preferred to be smaller than that of the color developing layer 9.

When the width of the dye layer transfer sheet 18 is greater than that of the color developing layer 9, creasing can take place in the dye layer transfer sheet 18 during recording, this also being the case with the recorded pictorial image. This is because, although in the part where the color developing layer 9 is under the dye layer transfer sheet 18, the dye layer transfer sheet 18 elongates due to the heat and frictional force of the recording means 19 in the part where the width of the dye layer transfer sheet 18 is greater than that of the color developing layer 9. This is because in the edge portions of the dye layer transfer sheet 18 with no color developing layer thereunder no elongation can occur due to sticking to the rubbery surface layer 3. Hence, the width of the dye layer transfer sheet 18 is preferred to be smaller than that of the color developing layer 9. This constitution is also preferred for its safety from the peeling noise for the dye layer transfer sheet 18 does not come into contact with the rubbery surface layer 3.

To prevent creasing the dye layer transfer sheet 18 during recording, the surface of the surface layer 3 may be imparted with concavo-convex roughness to make it less sticky to the surface layer 3. The result of our extensive studies shows that the gloss of the concavo-convex roughness of the surface of the surface layer 3 is preferably less than 50 in glossimeter reading (Horiba Seisakusho, Ltd.: IG-320: JIS-Z 8741 Gs (60°)), and less than 40 still more preferably. When a partially glazed thermal head is used as part of the recording means 19, it is extremely effective against the risk of creasing of the dye layer transfer sheet 18 when it is arranged so that the dye layer transfer sheet 18 does not come into contact with the surface layer 3 behind the partial glaze (portion close to the supply roller 6).

By this arrangement it is possible to effect migration of the dye to the color developing layer 9 from the dye layer 13 stably, without peeling noise or creasing of the dye transfer sheet 18 or without any risk of the surface layer 3 being stained by the dye migrated from the dye layer 13 and with stable migration of the dye to the color developing layer 9 on the surface layer 3.

This recording process for yellow is repeated for magenta (14) and cyan (15) in exactly the same way and a full color pictorial image can be formed thereby in the color developing layer 9 on the surface layer 3. After migration of all dyes from the dye layer transfer sheet 18 to the surface layer 3 the thermal head 19 and the color developing layer transfer sheet 18 are detached from the surface layer 3 as shown in FIG. 2(C).

Finally, as seen from FIG. 2(C), the full color pictorial image recorded in the color developing layer 9 on the surface 3 is brought into contact with the color receiving sheet 21 such as a post card or ordinary paper, a heater such as a halogen lamp is inserted into the aluminum roll and by the heat and pressure of the heat roll 22 made of aluminum and a covering heat-resisting rubber layer such as of silicone rubber the color developing layer 9 on the surface layer 3 is transferred to the color receiving sheet 21 and fixed thereon and a full color recording pictorial image is thus formed on the color receiving sheet 21. If necessary, the surface layer 3 may be separated from the color receiving sheet 21 by the use of the color receiving sheet separating nail 23. Since, as seen from the curve B of FIG. 6, the adhesive force between the color developing layer 9 and the surface layer 3 decreases with increasing temperature, the color developing layer 9 is easier to transfer from the surface layer 3 to the color receiving sheet 21 when the temperature is higher. Hence, it is advisable to separate the color receiving sheet 21 from the surface layer 3 at a position as close to the heat roll 22 as possible. If the transfer temperature is raised above the flow softening point of the bonding resin of the color developing layer 9, the film strength of the color developing layer 9 is markedly decreased, the film is severed inside the color developing layer 9, which results in failure of transfer of the color receiving layer 9 from the surface layer 3 onto the color receiving sheet 21, hence it is necessary to lower the temperature, to which the color developing layer 9 is subjected at the time of transfer, to below the flow softening point of the bonding resin of the color developing layer 9 or separate the color receiving sheet 21 from the surface layer 3 after cooling with the color receiving sheet separating position displaced.

Thus, the invention enables formation of a full color recorded pictorial image on all kinds of color receiving sheets, whereas it was previously possible only with exclusive paper.

FIGS. 7(A) and (B) are schematic diagrams of an embodiment of the thermal transfer printing method of the invention. As seen from FIGS. 7(A) and (B), the first point of difference from FIG. 1 is that the color developing layer transfer means 1 and the recording means 19 can exhibit their functions when they are used with the same thermal head 1. The same is true also with the color developing layer cooling roller 11 and the dye layer cooling roller 20, which are identical here. One point of difference from the embodiment of FIG. 1 is that the color developing layer 9 and the dye layers 13–15 are disposed on the same transfer substrate 24.

The working principle of the invention will now be explained. First, the transfer sheet 26 is held between the thermal head 1 and the intermediate medium 5 so that the color developing layer 9 of the transfer sheet 26 comes into contact with the intermediate medium 5, the heated head 1 is heated for heating the supporting drum 2 being driven in the direction indicated by the arrow, a part of whole of the color developing layers 9 are softened and thereafter the part having the color developing layer thereon or the whole is transferred from the transfer sheet 26 onto the surface layer 3. The thermal head 1 is then once detached from the surface layer 3. This color developing layer formation process is exactly the same as in the embodiment shown in FIG. 1. Then, the thermal head 1 is once detached from the surface layer 3 and then the winding roller 12 and the supporting drum 2 are rotated for position matching for the color developing layer 9 and the yellow dye layer 13 on the surface layer 3 come into contact. Next, the thermal head 1 is pressed against the surface layer 3, the thermal head 1 is heated for heating the supporting drum 2 being rotated in the direction indicated by an arrow and the dye is caused to migrate thermal head 1 and the intermediate medium 5 so that the color developing layer 9 of the transfer sheet 26 comes into contact with the intermediate medium 5, the thermal head 1 is heated for heating with the supporting drum 2 being rotated in the direction indicated by the arrow, a part or whole of the color developing layer 9 is softened and thereafter it is transferred from the transfer sheet 26 onto the surface layer 3. This color developing layer formation process is entirely the same as in the embodiment shown in FIG. 1. Then, the thermal head 1 is separated from the surface layer 3 and then the winding roller 12 and the supporting drum 2 are rotated for position matching for the color developing layer 9 and the yellow dye layer 13 on the surface layer 3 come into contact. Next, the thermal head 1 is pressed against the surface layer 3, the thermal head 1 is heated for heating with the supporting drum 2 being rotated in the direction indicated by the arrow, and the dye is caused to migrate from the dye layer 13 to the color developing layer 9 and a yellow recorded pictorial image is formed on the color developing layer 9. After migration of the yellow dye from the dye layer 13 to the color developing layer 9, the dye layer 13 is separated from the color developing layer 9 on the surface layer 3. The process for forming the yellow pictorial image is repeated for magenta and cyan in exactly the same way and recording of a full color pictorial image is finished. Upon completion of migration of all dyes from the transfer sheet 26 to the color developing layer 9 on the surface layer 3, the thermal head 1and the transfer sheet 26 are detached from the surface layer 3. Finally, the full color pictorial image formed in the color developing sheet 9 is brought into contact with the color receiving sheet 21 such as a post card or ordinary paper, the color developing layer 9 on the surface layer 3 is transferred from the intermediate medium 5 to the color receiving sheet 21 and fixed thereon by the heat and pressure of the heat roll 21 and a full color pictorial image is thus formed on the color receiving sheet 21. If necessary, the color receiving sheet 21 is separated from the intermediate medium 5 by the use of the color receiving sheet separating nail 23.

This way, a substantial portion of constituent parts and materials can be dispensed with compared with the embodiment shown in FIG. 1 and the required equipment can be largely downsized.

FIGS. 8(A) and (B) show schematic diagrams of one embodiment of the thermal transfer printing method of the invention. In FIG. 8(A) the intermediate medium 5 is endless belt shaped and the heat roll 22 is disposed inside the intermediate medium 5, these being the only points of difference from FIGS. 7(A) and (B). In FIG. 8(A) reference numeral 27 represents a platen roller, 28 an idler roll and 29 a roller respectively. The working principle of the invention is exactly the same as the embodiment of FIG. 7 and the explanation about it is omitted here. One advantage of this constitution is that, when the color developing layer 9 on the surface layer 3 is transferred to the color receiving sheet 21 heating is made from the intermediate medium 5 side by means of the heat roll 22, hence the transfer temperature is not required to be raised even if the color receiving sheet 21 is thick. Also, at least one of the rolls retaining the intermediate medium 5 may be used for preventing meandering of the intermediate medium 5. For example, it is possible to make the idler roll 28 drum-like for preventing meandering. It is also possible to prevent meandering by properly moving the axis of the idler roll 28.

In the embodiments described above a thermal head was used as the color developing layer transfer means but it is good enough that the color developing layer 9 is heated, so a metal roll may be used as well. Although a thermal head was used as recording means, anything usable for migrating the dye in the dye layer into the color developing layer can be used, and an electrically heated head, photo head or the like may also be used. A heat roll may as well be used if it is capable of supplying heat and pressure like flat heaters.

FIGS. 4(A)–(C) and 5(A)–(E) are schematic diagrams showing the color developing layer transfer sheet 10, which is composed of at least color developing layer substrate 7 and color developing layer 9. When a thermal head is used in a color developing layer transfer means 1, a heat-resisting and slipping layer 8 is required on one side of the color developing layer substrate 7. In FIG. 4(A) the heat-resisting and slipping layer 8 is formed all over on one side of the color developing layer substrate 7, a patterned release layer 25 is formed on the other side thereof and the color developing layer 9 smaller in size than the release layer 25 is provided thereon. A marker 43 is disposed in front of each release layer 25. FIG. 5(A) shows a color developing layer transfer sheet 10 with the parts of the color developing layer substrate 7 on both sides of the release layer 25 totally eliminated. FIG. 5(C) shows a color developing layer transfer sheet 10 whose width is the same as that of the color developing layer 9. FIG. 5(E) shows an embodiment in which a macromolecular substance layer 30 is laminated on the color developing layer 9. The macromolecular substance layer 30 is composed of materials higher in glass transition temperature ("Tg" hereinafter) than the bonding resin of the color developing layer 9 for prevention of migration of the dye penetrating through the color developing layer 9 to the surface layer 3 as the recording pictorial image is formed in the color developing layer 9 on the surface layer 3, and as the color developing layer 9 on the surface layer 3 is transferred from the intermediate medium 5 to the color receiving sheet 21. The color developing layer transfer sheet 10 may have the color developing layer substrate 7 provided with anchor layers all over or partly for enhancing the adhesiveness of the release layer 25 and the marker 43.

The color developing layer substrate 7 may be made of any suitable material without limitation such as film of e.g. polyester, polystyrene, polypropylene, polysulfonic acid, aramid, polyimide, polyparabanic acid, polycarbonate, polyvinyl alcohol and cellophane or coated films, paints suited for the purpose being electroconductive paints, primer paints, antistatic paints and heat-resisting and lubricant paints. Especially preferred for this purpose is polyester film.

There is also no particular limit for the material of the color developing layer 9 and suitable materials include known resins such as various thermoplastic resins and various thermosetting resin (e.g. vinyl-type resins such as polyvinyl acetate and vinyl chloride-vinyl acetate copolymer, polyvinyl acetal-type resins such as polyvinyl formal, polyvinyl butyral, acetoacetarized polyvinyl alcohol, polypion-acetarized polyvinyl acetal as well as styrene-acrylonitrile copolymer resins, vinyl chloride-acryl copolymer resin, polyacrylamide-type resins and polyester-type resins such as saturated polyester). It is desirous that, particularly, the color developing layer 9 contains at least a polyvinyl acetal-type resin. Polyvinyl acetal is a resin obtainable by reacting various aldehydes such as formaldehyde, acetaldehyde and propion aldehyde with polyvinyl acetal. For material of the color developing layer 9 particularly suited are resins 40° to 150° C. in Tg (glass transition temperature), 150–3000 in mean polymerization degree or no more than 300° C. in flow softening temperature. When the color developing layer 9 contains either or both of fluorine-containing moisture-cured type resin and siloxane-containing moisture-cured resin, it is extremely suited for prevention of fusion with the dye layer during recording. For preventing fusion with the dye layer during recording it is also possible to use one of hitherto well known anionic surface active agents such as carboxylates and sulfonates and sulforic esters, cationic surface active agents such as aliphatic amine salts, aliphatic quadrant ammonium salts, aromatic quadrant ammonium salts and heterocyclic quadrant ammonium salts, ethers such as polyoxyethylene alkyl ether and polyoxyethylene alkylphenyl ether, ether-esters such as polyoxyethylene glycerin fatty acid ester and polyoxyethylene sorbitan fatty acid ester, esters such as polyethylene glycol fatty acid ester, fatty acid monoglyceride, sorbitan fatty acid ester, propylene glycol fatty acid ester and sucrose fatty acid ester, nitrogen-containing type of various nonionic surface active agents such as fatty acid alkanol amide and polyoxyethylene oxide, ampholytic surface active agents such as of betaine type, aminocarboxylic acid type and imidazoline derivatives, fluorine-type surface active agents such as fluoroalkyl ($C_2$–$C_{20}$) carboxylic acids, monoperfluoroalkyl ($C_6$–$C_{16}$) ethyl phosphoric acid esters and perfluorooctane sulfonic acid diethanolamide, modified silicone oils such as polyether-modified silicone oils, carboxyl modified silicone oils, alkylarakyl polyether modified silicone oils and epoxy polyether modified silicone oils, and silicone-type surface active agents such as various polyoxyalkylene glycol/silicone copolymers. Further, surface active agents called high-polymer surfactants, organic metal surfactants or reactive surfactants may be used as well. The color developing layer 9 may, if necessary (for instance, where the dye layer includes leuco dyes), include some developer such as an electron competent substance. Suitable electron competent substances are known, and include, among others, phenolic compounds such as Bisphenol A, carboxylic acid type compounds, silica and active China clay.

A preferable thickness of the color developing layer 9 is 0.5–20 $\mu$m, more preferably 1–5 $\mu$m.

The macromolecular substance layer 30 has no particular limitation for its material and, for example, various thermoplastic resins and resins cured by heat, light, electric ray or the like may be used. Suitable resins include those of acrylic type, urethane type, amid type, ester type, cellulose type, styrene type, olefin type etc. It is preferable to use at least one of macromolecular substances such as acrylonitrile-styrene copolymer resin, styrene-acryl copolymer resin, rubber chloride, chlorinated polypropylene, chlorinated vinyl resin, chlorinated vinyl chloride resin, vinyl acetate resin, chlorinated vinyl-acetic acid vinyl copolymer resin, chlorinated vinyl-acrylic acid ester copolymer resin, saturated polyester, polypropylene, polyester urethan, polyvinyl acetal, polyvinyl alcohol, cellulose derivatives, processed starch, starch derivatives and polycarbonate. Derivatives of polyvinyl alcohol include, among others, various polyvinyl acetals, particularly suited being the aforementioned polyvinyl acetals. As the macromolecular substance layer 30 particularly useful are those higher in glass transition temperature (Tg) than the color developing layer 9.

A preferable thickness of the macromolecular layer 30 is 0.1–10 $\mu$m, and more preferably 0.5 to 5 $\mu$m.

Suitable heat-resisting and slipping layers 8 include any of the hitherto known substances, for example, various thermoplastic resins and various resins cured by heat, light, electronic ray etc. Particularly preferable are various cured resins in adhesivity and heat resistance. Such resins include, among others, silicone resin, epoxy resin, unsaturated aldehyde resin, urea resin, unsaturated polyester resin, alkyd resin, furan resin and oligoacrylate resin. Particularly suited is a cured resin of oligoacrylate cured resin. Since resins cured by light or electron ray are easily cured in a short length of time and, with scarcely any risk of transfer of unreacted resin or hardener to the color developing layer, an endless supply of transfer sheet is easy to prepare, and the prepared sheet is excellent in properties. For example, photo-cured oligoacrylate resin and photo-curing of epoxy resins by the use of aromatic diazonium salt, aromatic iodonium or aromatic sulfonium salt as catalyst are particularly excellent. Known oligoacrylate include among others, polyol acrylate, polyester acrylate, epoxy acrylate, urethane acrylate, silicone acrylate and polyacetal acrylate. Known epoxy resins include, for example, cycloaliphatic epoxy resins such as vinyl cyclohexane dioxide, 3,4-epoxychlorohexyl methyl-3,4-epoxycyclohexylmethyl-3,4-epoxycyclohexane carboxylate. It is also possible to add tetra-hydrofurfuryl acrylate, lauryl acrylate etc to resins as reactive diluent.

It is preferable to add to the aforementioned resins a lubricant for improved lubricity against the thermal head. When the color developing layer transfer means 1 prepared using a liquid lubricant was stored for repeated recording, however, it became progressively difficult to form the color developing layer 9 on the surface layer 3 from the color developing layer transfer means in the color developing layer formation process with increasing number of recording attempts. The survey showed it was due to transfer of the liquid lubricant in the heat-resisting and slipping layer transferred to the surface layer 3 to accumulate thereon. The result of our extensive studies showed that, of the liquid lubricants, side-chain polyether modified silicone oil was excellent with the least risk of transferring to the surface layer 3 to accumulate thereon. Specifically, Nippon Unicar, Ltd.'s L-77, L-720, L-7001, L-7002, L-7600, L-7602, L-7604, L-7607, L-22, L-49, Y-7006 etc. turned out to be good in this respect. These may be used in combination with other lubricants as well. It was also discovered that the molecular weight of the functional groups in the polyether contained in the lubricant played an important role. he more its molecular weight, the less the risk of the lubricant transferring from the heat-resistant and slipping layer 8 to the surface layer 3. This was because of the increasing adhesiveness to the resin contained in the heat-resisting and slipping layer 8. For increasing the slipperiness between the thermal head and the heat-resisting and slipping layer 8, the molecular weight of siloxane contained in the lubricant may be increased.

L-7602 has a molecular weight of the functional groups of the contained polyether of 1000, and siloxane's molecular weight is 2,000. Y-7006 has a molecular weight of 12,000 in the functional groups of the contained polyether, and silocane's molecular weight is 6,000. In our experiment Y-7006 proved to be better than L-7602 in slipperiness between the thermal head and the heat-resisting and slipping layer 8, being also better in no risk of accumulation on the surface layer 3.

Also, particularly suited for this purpose is the combination of side-chain polyether-modified silicone oil and epoxy resin photo-cured by the use of oligoacrylate salt, aromatic iodonium salt or aromatic sulfonium salt as catalyst. In our experiment with Y-7006 for lubricant, epoxy acrylate for resin and fluorine rubber for the surface layer 3 (specifically, the materials used in Example 3) no indication of transfer of the lubricant to the surface layer 3 was noted. Hence, the combination of Y-7006 and epoxy acrylate resin is excellent in lubricity and features no risk of accumulation on the surface layer 3.

There is no particular limitation for the thickness of the heat-resisting and slipping layer. For manufacturing reasons, however, uniform film thickness can be achieved when the film thickness is no less than 0.1 μm.

There is no particular limitation for the release layer 25, either, and, for example, even any of the materials cited above as macromolecular substances may be used as well. Various mold release agents alone or in combination with macromolecular substances may be used as well. Suitable mold release agents include silicone-type mold releasing agents such as dimethyl silicone oil, phenyl silicone oil and fluorine silicone oil, reactive or modified silicone oils such as of SiH-modification type, cyranol-modification type, alkoxy-modification type, epoxy-modification type, amino-modification type, carboxy-modification type, alcohol-modification type, mercapto-modification type, vinyl-modification type, polyether-modification type, fluorine-modification type, higher fatty acid-modification type, carnauba-modification type, amide-modification type and alkylaryl-modification type and surface active agents cited above in connection with the color developing layer, various resins of silicone- or fluorine-modification type. Particularly recommended are silicone-acryl copolymers. Also carious silicone rubbers and resins of hot vulcanizing type, room temperature curing type, liquid type, condensation reaction type, addition reaction type, peroxide curing type, and UV-curing type etc. as well as various silicone emulsions, various silicone resin powders and various silicone rubber particles. Uses fluorine-type mold releasing agents include various fluorine resins such as polytetrafluoroethylene and tetrafluoroethylene perfluoroalkylvinyl ether copolymers, fluorine rubbers such as vinylidene fluoride hexafluoropropylene-type rubber, various fluorine-type surface active agents, fluorinated carbon, various fluorine rubber latex and fluorine-containing resins. Also, addition of various adhesive and various fine particles may be considered for control of the release property of the mold release agents.

A preferred thickness of the mold release agent 25 is 0.1 to 5 μm, more preferably 0.1 to 3 μm. The force required for peeling the release layer 25 from the surface layer 3 may preferably be no more than 50 g/inch at 25° C., more preferably no more than 20 g/inch. The measuring method for the peel strength is as follows. The color developing layer transfer sheet 10 without the color developing layer 9 (6 μm thick) is used and "stuck together" with the surface layer 3 and the release layer 25 in contact, the thermal head 1 is heated (same as the forming conditions in the Example 3 below) for sticking together the surface layer 3 and the color developing layer transfer sheet 10. The color developing layer transfer sheet 10 is left on the surface layer 3 with its width reduced to 19 mm, a commercially available adhesive cellophane tape 37 μm thick and 18 mm wide is stuck over it and one end of the adhesive cellophane tape is pulled up vertically (180°) and the tension is then measured.

Figure 9:
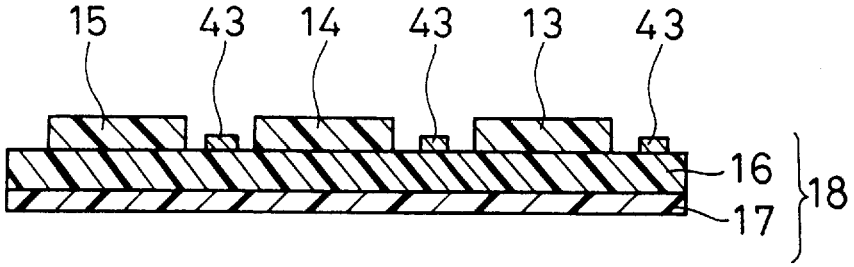
FIGS. 9(A) and (B) are schematic diagrams showing the dye layer transfer sheet.
Figure 9:
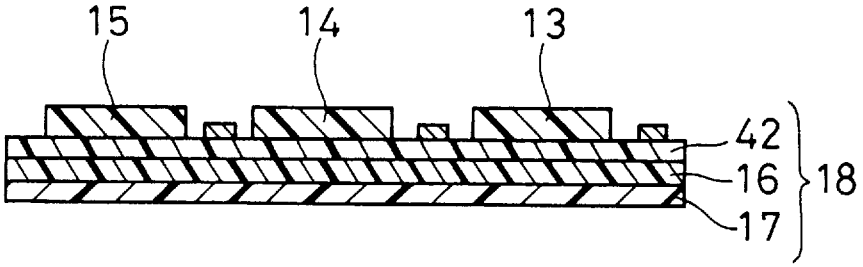

FIGS.9(A) and 9(B) are schematic diagrams of the color developing layer transfer sheet 10 used for thermal transfer printing method of the invention.

As shown in FIG. 9(A), the dye layer transfer sheet 18 comprises at least a dye layer substrate 16, a heat-resisting and slipping layer 17, a yellow dye layer 13, a magenta dye layer 14 and a cyan dye layer 15. As seen from FIG. 9(B), an anchor layer 42 may be provided between the dye layers 13–15 and the dye layer substrate 16 for an increased "adhesive force" between the dye layers 13–15 and the dye layer substrate 16. If necessary, a marker 43 may be located at a proper position in front of each dye layer. As the dye layer transfer sheet 18 any known equivalent may be used. Each of the dye layers 13–15 is composed of at least a dye and a binder. Proper dyes include, among others, disperse dyes, basic dyes and color formers. Particularly suited are disperse dyes of indoaniline type, quinophthalone type, dicyanoimidazol type, dicyanomethine type, tricyanovinyl type etc. As binders may be used, for example, various high polymer (macromolecular) materials, i.e. resins of acryl type, urethane type, amide type, ester type, cellulose type, styrene type, olefin type etc. It is preferable to use at least one kind of high polymer substance selected from acrylonitrile-styrene copolymer resins, polystyrene, styrene-acryl copolymer, chlorinated rubber, chlorinated polypropylene, vinyl chloride resins, chlorinated vinyl chloride resins, vinyl acetate resins, vinyl chloride-vinyl acetate copolymer resins, vinyl chloride-acrylic (acid) ester copolymer resins, saturated polyester, polypropylene, polyester-urethane, polyvinyl acetal, polyvinyl alcohol, cellulose derivatives, processed starch, starch derivatives or polycarbonate. Also, lubricants (fluorine-containing moisture-cured type resins, siloxane-containing moisture-cured type resins and surface active agents cited in connection with the color developing layer) may be used as well as fine particles and antistatic agents.

A preferred thickness for the dye layers 13–15 is from 0.1 to 10 μm, preferably in a range of 0.5 to 3 μm.

The dye layer substrate 16 and the heat-resisting and slipping layer 17 are identical with those cited in relation to the color developing transfer sheet 10, hence description thereof is omitted.

Figure 10:
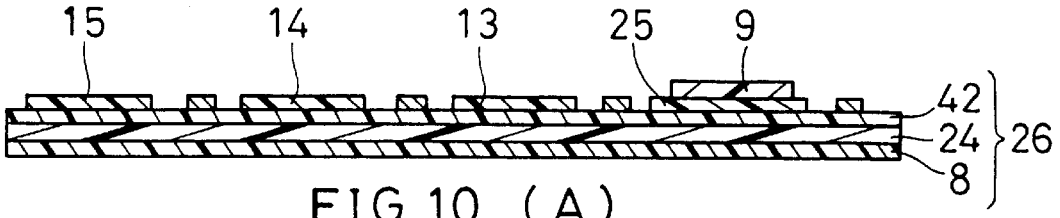
FIGS. 10(A)–(E) are schematic diagrams showing the transfer sheet.
Figure 10:
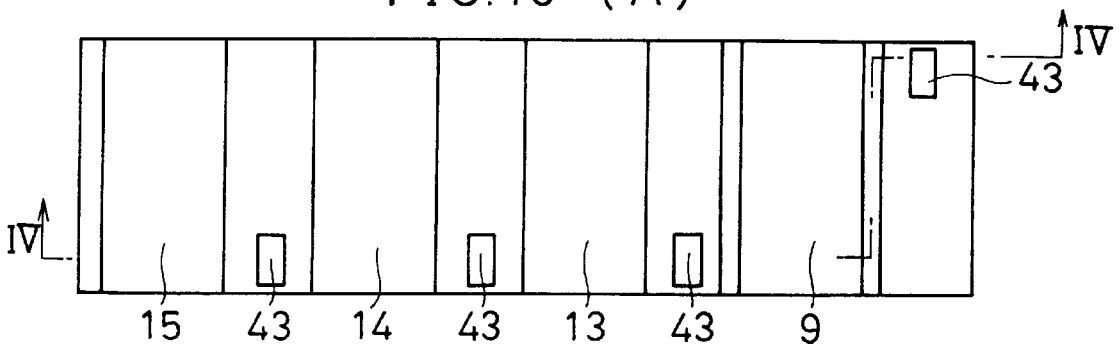
Figure 10:
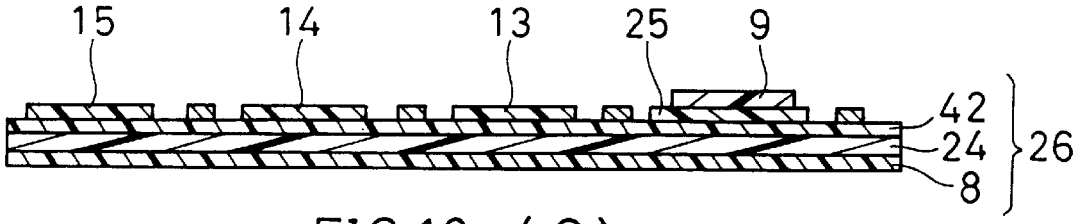
Figure 10:
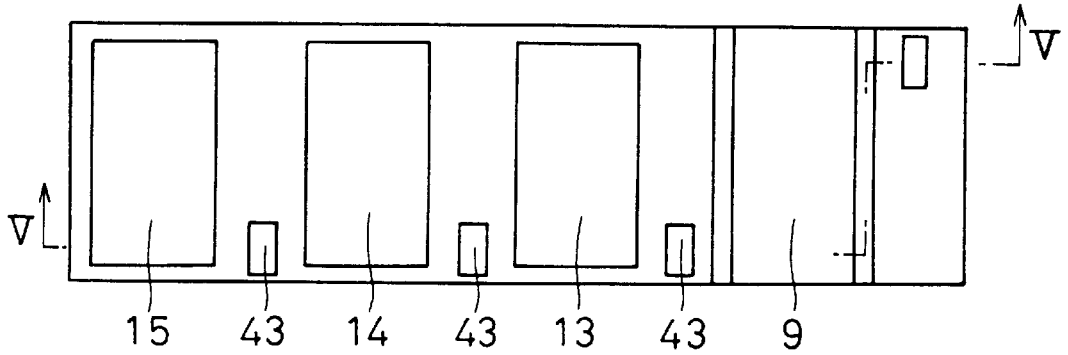
Figure 10:
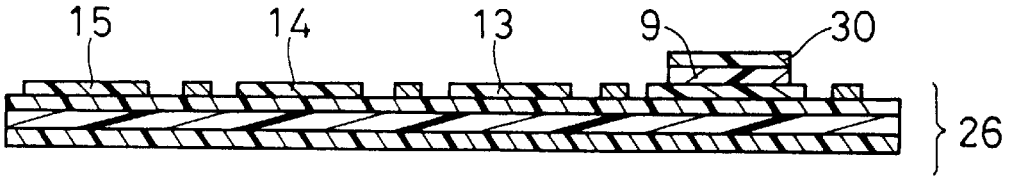

In FIG. 10(A), the transfer sheet 26 of this invention is shown. In this embodiment the heat-resisting and slipping layer 8 is formed on one side of the transfer substrate 24 and the anchor layer 42 is set on the other side thereof, and on the anchor layer 42 the release layer 25, color developing layer 9 and dye layers 13–15 are arranged on the same plane in a predetermined pattern. The width of the color developing layer 9 and the dye layers 13–15 is same as the width of the transfer sheet. The shape of the color developing layer 9 may as well be as indicated in FIG. 4(A) and FIG. 5(A). The transfer substrate 24, release layer 25, color developing layer 9, dye layers 13–15 and heat-resisting and slipping layer 8 are the same as the materials explained in relation to the color developing layer transfer sheet in FIGS. 4(A) and (B) and FIGS. 5(A)–(E) and the dye layer transfer sheet 18 in FIGS. 9(A) and (B). For prevention of dye migration from the dye layers 13–15 to the surface layer 3 it is advisable to make the width of the dye layers 13–15 smaller than the width of the color developing layer 9 as seen from FIG. 10(D). As shown in FIG. 10(E), it is recommended to form a macromolecular substance layer 30 on the color developing layer 9 to ensure against dye migration onto the surface layer 3.

The schematic diagram of the intermediate medium 5 is shown in FIG. 11(A)–(D). As seen from FIG. 11(A), the intermediate medium 5 is composed of at least the surface layer 3 and the intermediate transfer substrate 4.

The surface layer 3 may be made of many alternative rubber materials, i.e. various synthetic rubbers such as fluorine contained rubber, silicone rubber of the peroxide curing type, condensation reaction type, addition reaction type and UV-cured type, fluoro-silicone rubber, urethane rubber, chloroprene rubber, isoprene rubber, butyl rubber, butadiene rubber-vinyl acetate rubber, ethylene-acryl rubber, hydrogenated nitrile rubber and natural rubber. It is also possible to mix these rubbers for adjustment of the adhesive force between the color developing layer and the surface layer 3. This adjustment of the adhesive force between the color developing layer 9 and the surface layer 3 may as well be done through mixing the the material resins. For example, various fluorine resins e.g. polytetrafluoroethylene and tetrafluoroethylene perfuloroalkylvinylether copolymers are useful. It is also possible to include any adhesive, micropowder (supermicropowder) and antistatic in the surface layer 3 such as carbon black (MT carbon or FT carbon), white carbon, magnesium oxide, synthetic non-crystalline silica, titanium oxide, talc, calcium hydroxide, calcium carbonate, calcium silicate, barium sulfate, clay, Indian red and graphite powder.

When in the setup of FIGS. 8(A) and (B) (under conditions same as in Example 3) with post cards as color receiving sheets 21 a continuous test of 10,000 cycles was made and the results showed that, of the aforementioned rubber materials, fluorine contained rubber was the best for this purpose. Even after 10,000 cycles of continuous test the fluorine contained rubber was found operating quite stably with its surface showing no indication of roughness. The surface roughness was measured by a glossimeter and a roughness meter. The fluorine rubber is resistant to heat, chemicals and weathering, being high in strength, hence it is best suited for the surface layer 3 of the intermediate medium 5.

The fluorine contained rubbers comprise a binary copolymers of vinylidene fluoride and hexafluropropylene, a binary copolymer of vinylidene fluoride and chlorotrifluoroethylene, a binary copolymer of vinylidene fluoride and chlorotrifluoroethylene, a ternary copolymer of vinylidene fluoride, hexafluoropropylene and tetrafluoroethylene, a ternary copolymer of vinylidene fluoride, pentafluoropropylene and tetrafluoroethylene and a ternary copolymer of vinylidene fluoride, perfluoromethy (lene)vinyl ether and tetrafluoroethylene. There are three methods for vulcanizing fluorine rubber, namely polyamine, polyol and peroxide types thereof. The adhesive force between the color developing layer 9 and the surface layer 3 is adjustable by mixing some other type of rubber with the fluorine contained rubber.

When continuous operation was done with the machine setup shown in FIG. 1 under conditions of drum rotary speed of 10 mm/sec. (drum diameter 100 mm), heat roller temperature 160° C. and operating environment of 5° to 40° C. and the temperature variation range of the surface layer 3 measured at the color developing layer cooling roller was 5° to 60° C. Then, the color developing layer 9 was transferred stably from the color developing layer transfer sheet 10 to the surface layer 3, when the temperature of the surface layer 3 was in a range of 0° to 70° C. with a reasonable allowance, and it was thus confirmed that the minimum adhesive force between the surface layer 3 and the color developing layer 9 required with the color developing layer 9 retained on the surface layer 3 for proper recording was 5 g/inch. The test result also showed that for stable running with the surface layer 3, the color developing layer transfer sheet 10 and the dye layer transfer sheet 18 easily separable, the adhesive force between the surface layer 3 and the color developing layer transfer sheet 10 and between the surface layer 3 and the dye layer transfer sheet should be no more than 100 g/inch. It also turned out that, when the color receiving sheet 21 is separated from the surface layer 3, the adhesive force required is no more than 50 g/inch for stable transfer of the color developing layer 9 from the color receiving sheet 21 and stable separation of the color receiving sheet 21 from the surface layer 3 with no peeling noise. Hence, the adhesive force between the surface layer 3 and the color developing layer 9 is required to be no less than 5 g/inch when the temperature of the surface layer is 0° to 70° C., the adhesive force between the surface layer 3 and the color developing layer transfer sheet 10 and between the surface layer 3 and the dye layer transfer sheet 18 is required to be no more than 100 g/inch and, when the color receiving sheet 21 is separated from the surface layer 3, the adhesive force between the surface layer 3 and the color developing layer 9 is required to be no more than 50 g/inch.

The method of measuring the adhesive force between the surface value 3 and the color developing layer 9 is as follows. The color developing layer 9 is formed 19 mm in width on the surface layer 3 with the thermal head 1 heated in advance (conditions same as the forming conditions in Example 3), a commercially available adhesive cellophane tape 18 mm-wide and 37 μm thick is stuck to the color developing layer 9, it is pulled up vertically (180°) at a rate of 10 mm/sec. and the tension is then measured. The method of measuring the adhesive force between the surface layer 3 and the color developing layer transfer sheet 10 and between the surface layer 3 and the dye layer transfer sheet 18 is essentially the same. The color developing layer transfer sheet 10 having a width of 19 mm and a thickness of 6 μm, or the dye layer transfer sheet 18 having a width of 19 mm and a thickness of 6 μm is formed on the surface layer 3 with the thermal head 1 heated in advance (conditions same as the forming conditions in Example 3), the commercially available adhesive cellophane tape 18 mm-wide and 37 μm thick is stuck to the color developing layer 9, it is pulled up vertically (180°) at a rate of 10 mm/sec. and the then tension is measured. The method of measuring the adhesive force between the surface layer 3 and the color developing layer transfer sheet 10 and between the surface layer 3 and the dye layer transfer sheet 18 is essentially the same. The dye color developing layer transfer sheet 10 (6 μm thick) or the dye layer transfer sheet 18 (6 μm thick) is formed on the surface layer 19 mm wide (conditions same as the forming conditions in Example 3) and then the color developing layer transfer sheet 10 or the dye layer transfer sheet 18 is pulled up vertically (180°) at a rate of 10 mm/sec. and then the tension is measured.

The thickness of the surface layer 3 is preferably no less than 10 μm because it is transferred to the surface of the color receiving sheet (ordinary paper, bond paper, post cards or the like), which is subject to some degree of roughness.

When the color developing layer 9 on the surface layer 3 is transferred onto the color receiving sheet 21 by means of an endless belt (intermediate medium 5), the color developing layer 9 is heated from the intermediate medium 5 side by the heat roll 22. Therefore, when heat transmission is taken into consideration, the surface layer 3 is required to be as thin as possible, a preferred range of layer thickness being 10 to 200 μm, more preferably 10 to 50 μm. In order to make the thickness of the surface layer 3 less than 200 μm, however, the (surface of) intermediate transfer substrate 4 has to be coated with a liquefied material of the surface layer 3. Although the fluorine rubber before vulcanization, which is insoluble in other solvents, is soluble only in ketone-type solvents, hence liquefied rubber for coating can be prepared by first kneading the rubber powder and then dissolving it in a ketone solvent. When the surface layer 3 is formed by coating, it is sometimes the case that the surface of the surface layer 3 formed becomes rough, looks white and cloudy and even pitting is caused (especially when the humidity is higher than 60% RH or when wind flow rate for drying is high). This is due to evaporation of the solvent, hence it is advisable to use a ketone solvent whose boiling point is higher than 100° C., especially 4-methyl-2-pentanone(methyl isobutylketone) which is also inexpensive.

There is a good alternative method. When fluorine contained rubber vulcanized with polyamine is dissolved in a ketone-type solvent and is left standing at the room temperature, the solution is set (by gelation) in 4–5 days. Of fluorine contained rubbers, the polyol-vulcanized fluorine contained rubber liquefied for coating is particularly slow to set, having setting time of more than one month at the room temperature and being highly recommendable also in this respect.

For smoothness of the surface layer it is advisable to use a fluorine contained rubber of no more than 50 in Mooney viscosity for finish (topmost) coating.

For meeting the surface roughness of the color receiving sheet the rubber hardness of the surface layer 3 is desired to be as low as possible. The fluorine contained rubber as material of the surface layer 3 is required to contain per 100 wt. parts of raw rubber at least 0–90 wt. parts of carbon black (MT carbon black or the like), 5–30 wt. parts of magnesium oxide and 1–20 wt. parts of one of polyamine, polyol, peroxide et cetera as vulcanizing agent and the mixture is kneaded well after addition thereof. To lower the fluorine contained rubber hardness, the carbon black and magnesium oxide contents of the rubber should be lowered.

It is particularly preferable to impart a concavo-convex roughness to the surface of the surface layer 3 as seen from FIG. 11(B) and FIG. 11(C), for it enables elimination of the risk of creasing of the color developing layer 9 and peeling noise of the color developing layer transfer sheet 10 in the color developing layer forming process, and the risk of creasing and peeling noise of the dye layer transfer sheet 18 during recording, while it also enables easy separation of the color receiving sheet 21 from the surface layer 3. As to the degree of concavo-convex roughness, it is preferable, as already mentioned, if the glossimeter reading is less than 50 (Horiba Seisakusho, Ltd.: IG-320: JIS-Z 8741 Gs (60°)), more preferably less than 40. To impart concavo-convex roughness to the surface of the surface layer 3, a film with concavo-convex roughness on one side may be laid on one side of a raw rubber sheet before vulcanization and after molding under pressure the film may be pulled off or alternatively the surface of the sheet may be roughened by sand-blasting. Another alternative is to add to the rubber material fine particles 44 more than 1 $\mu$m in particle size to produce concavo-convex roughness. As the fine particles 44 may be used those hitherto known as mentioned above. Fine particles of magnesium oxide may be preferred when the material of the surface layer 3 is fluorine contained rubber.

To frost the surface of the color developing layer 9 transferred to the color receiving sheet, the surface of the surface layer 3 of the intermediate medium may be roughened properly.

Since the surface layer 3 is for transferring the color developing layer to the surface of the color receiving sheet 21 such as paper, the surface layer 3 is required to be as flexible as possible to meet the roughness of the color receiving sheet 21, hence the hardness of its material, rubber. is desired to be as low as possible. If the hardness of the material, rubber, of the surface layer 3 (JIS-A: 25° C.) is less than 70°, however, the color developing layer transfer sheet 10 or the dye layer transfer sheet 18 possibly become sticky to the surface layer 3 and difficult to separate therefrom. Hence, as seen from FIG. 11(D), it is desirous to have the surface layer 3 made up of no less than two layers, to use a rubbery material in excess of 70° (JIS-A) for the topmost layer 45 and use a rubber as soft as possible as material of the surface layer/s 3 thereunder.

When a fluorine contained rubber is used for the topmost layer 45, the pulverized material of raw fluorine contained rubber has to be added thereto per 100 wt. parts thereof at least 0 to −90 wt. parts of carbon black (MT carbon black etc.), 5 to 30 wt. parts of magnesium oxide and 1 to 20 wt. parts of one of polyamine, polyol, peroxide and the like as vulcanizing agent before kneading. To raise the hardness of the fluorine contained rubber for the topmost layer, it will suffice to increase the carbon black content of the fluorine contained rubber. To make the hardness of the rubber for the topmost layer exceed 70° (JIS-A), the carbon black content is adjusted to 10 to 90 wt. parts of the weight of raw fluorine contained rubber, preferably to 10 to 50 wt. parts).

For the surface layer(s) 3 under the topmost layer 45 the rubbery material should be soft and heat-resistant like those mentioned above.

The thickness of the topmost layer is as thin as possible, if it has the pressure required for printing, and is preferably no more than 10 $\mu$m thick. The thickness of the surface layer/s under the topmost layer 45 is preferably no less than 10 $\mu$m. Even in a two-layer structure, fluorine contained rubber is resistant to heat, chemicals and weather, and is high in strength. Hence it is suited as material for the topmost layer of the intermediate medium 5 and also the surface layer 3.

For the material of the intermediate transfer substance 4 there is no particular limitation, if it is heat-resistant, a metal sheet of, for example,iron or aluminum or heat-resistant high polymer film may be usable. There is no particular limitation about its shape, either. Hence it may be film, endless film or drum-shaped. As heat-resistant high polymer (macromolecular) film material of color developing layer substrate 7, for example, is usable, polyimide film or endless film being preferable. Since polyimide film or endless film is less adhesive to various rubbery materials, an anchor layer may be set between the intermediate transfer substrate 4 and the surface layer 3 for increasing the adhesive force therebetween. A surface layer 3 made of fluorine contained rubber and a coating is highly preferred for cost and time reasons due to its strong adhesion to polyimide without any anchor layer.

Illustrative example of suitable color receiving sheets 21 include non-coated paper, coated paper, film, sheet, transparent film for OHP, bond paper of increased surface roughness, ordinary paper, post card, synthetic paper etc. with no particular limitation about their material, paper quality or form.

Since the pictorial image recorded in the color developing layer 9 on the surface layer 3 is transferred to the color receiving sheet 21 and then fixed, the recorded pictorial image in the color receiving sheet 21 is a mirror image. Hence, the recording of the aforementioned pictorial image of the color developing layer 9 on the surface layer 3 is done with the bilateral symmetric nature of the recorded pictorial image into due consideration.

After transferring the color developing layer 9 to the color receiving sheet 21, it is possible to heat the color developing layer 9 on the color receiving sheet 21 so as to fix it on the color receiving sheet 21.

The recording method of the invention includes a recording method in which after a color developing layer 9 on an intermediate medium 5 is transferred to another intermediate medium it is retransfered to the final color receiving sheet 21 to be fixed thereon.

Specific embodiments will be described below. In the following examples, units are in parts by weight unless otherwise indicated.

EXAMPLE 1

Preparation of color development layer transfer sheet

Polyethylene terephthalate ("PET" hereinafter) 200 mm wide and 4.5 μm thick was used as color developing layer substrate and on one side thereof a UV-cured heat-resisting and slipping layer 1 μm thick was disposed. On the other side a release layer 180 mm wide, 260 mm long and 3 μm thick and on top thereof a patterned color developing layer was disposed for repetition of the construction of FIG. 5(A). A mark 43 for position matching was disposed in front of each patterned color developing layer 9.

| (Paint for heat-resisting and slipping layer) | |
|---|---|
| Epoxyacrylate resin (SP-1509: Showa Kobunshi, Ltd.) | 20 wt. parts |
| Sensitizer (2-hydroxy-2-methylpropiophenon) | 1 wt. part |
| Silica (R972: Nippon Aerozyl, Ltd.) | 4 wt. parts |
| Liquid lubricant (Y-7006: Nippon Unicar) | 0.4 wt. parts |
| Ethyl acetate | 100 wt. parts |
| (Release layer coating) | |
| Silicone rubber (LTC350G: Toray Dowcorning Silicone, Ltd.) | 10 wt. parts |
| Catalyst (SRX212, Toray Dowcorning Silicone, Ltd.) | 0.1 wt. part |
| Toluene | 30 wt. parts |
| (Color developing layer coating) | |
| Polyvinyl butyral resin (BL-S, Sekisui Chemical Industrial Co. Ltd.) | 4 wt. parts |
| Siloxane-containing acryl silicone resin solution (F6A, effective ingredient 54 wt. %: Sanyo Kasei, Ltd.) | 0.08 wt. parts |
| Di-n-butyl(me)dilaurate | 0.001 wt. parts |
| Toluene | 10 wt. parts |
| 2-butanone | 10 wt. parts |

Preparation of dye layer transfer sheet

PET 200 mm wide and 4.5 μm thick was used as dye layer substrate and on one side thereof a heat-resisting and slipping layer 1 μm thick was disposed. On the other side an anchor layer 0.1 μm thick anchor layer was formed with a patterned dye layer 1 μm thick thereupon and a dye layer transfer sheet in which the constitution of FIG. 9(B) is repeated. A mark 43 for position matching was disposed in front of each patternshaped.*

| (Yellow dye layer coating) | |
|---|---|
| Dicyanometine-type disperse dye | 2.8 wt. parts |
| Acrylonitrile-styrene copolymer resin | 4 wt. parts |
| Amido-modified silicone oil | 0.04 wt. parts |
| Titanium oxide (T805: Nippon Aerozyl, Ltd.) | 0.24 wt. parts |
| Toluene | 25 wt. parts |
| 2-butanone | 25 wt. parts |
| (Magenta dye layer coating) | |
| Azo-type disperse dye | 3.1 wt. parts |
| Acrylonitrile-styrene copolymer resin | 4 wt. parts |
| Amido-modified silicone oil | 0.04 wt. parts |
| Titanium oxide (T805: Nippon Aerozyl, Ltd.) | 0.24 wt. parts |
| Toluene | 25 wt. parts |
| 2-butanone | 25 wt. parts |

-continued

| (Cyan dye layer coating) | |
|---|---|
| Indoaniline-type disperse dye | 3.5 wt. parts |
| Acrylonitrile-styrene copolymer resin | 4 wt. parts |
| Amido-modified silicone oil | 0.04 wt. parts |
| Titanium oxide (T805: Nippon Aerozyl, Ltd.) | 0.24 wt. parts |
| Toluene | 25 wt. parts |
| 2-butanone | 25 wt. parts |

Preparation of intermediate medium

Polyimide film 250 mm wide, 314 mm long and 50 μm thick was used as intermediate medium substrate and a layer of fluorine contained rubber 400 μm thick (glossiness=35, rubber hardness 74°:25° C.) was formed and cured for no less than 8 hours at 200° C. to prepare an intermediate medium. A mark for position matching was set on the fluorine rubber.

| (Surface layer) | |
|---|---|
| Fluorine contained rubber (Bitone B: Showa Denko-Dupont, Ltd.) | 10 wt. parts |
| FT-carbon | 2 wt. parts |
| Magnesium oxide (Starmag L, Kamishima Kagaku, Ltd.) | 1.5 wt. parts |
| Polyamine vulcanizing agent | 0.3 wt. parts |

Now, the embodiment of the invention shown in FIGS. 2(A)–(C) will be described. The aforementioned intermediate medium 5 was wound round a supporting drum 2 made of aluminum. The color developing layer transfer sheet 10 and the dye layer transfer sheet 18 were set in a cassette, which was then set in the equipment. First, the mark on the intermediate medium 5 was detected by the sensor and the supporting drum 2 was rotated to the position where the color developing layer 9 was formed on the intermediate medium 5 was formed. Next, the marker on the color developing layer transfer sheet 10 was detected and the color developing layer transfer sheet 10 was sent to the position where the release layer 35 had passed the the thermal head 1. The thermal head 1 was pressed against the medium 5 and then heated for formation of the color developing layer 9 on the surface layer 3. The domain heated by the thermal head 1 was larger than the size of the color developing layer 9 and smaller than that of the release layer 25, as shown in FIG. 4(C). The forming conditions were as follows.

| | |
|---|---|
| Recording speed | 16.8 ms/line |
| Recording pulse width | 8 ms |
| Recording energy | 8.6 J/cm$^2$ |

Heating by the thermal head 1 was completed between the moment the heating element of the thermal head 1 had passed the end of the thermal layer 9 and the moment it had not yet passed the end of the release layer 25. Then, the heating element 1 was detached where the release layer 25 was in contact with the surface layer 3. Next, the dye was caused to migrate by the thermal head 19 from the yellow dye layer 13 to the dye layer transfer sheet 18. The then recording conditions were as follows.

| | |
|---|---|
| Recorded pictorial image | 16 gradations |
| Recording speed | 16.8 ms/line |
| Recording pulse width | 0–8 ms |
| Maximum recording energy | 8.6 J/cm$^2$ |
| Thermal head pressing force | 30 N |

The same process was repeated for recording of the magenta shade and cyan shade and the full color pictorial image was obtained.

Finally the color developing layer 9 on the surface layer 3 was brought into contact with an ordinary paper (copy paper) 21, a halogen lamp heater was inserted into the aluminum roll the color developing layer 9 on the surface layer 3 was transferred from the intermediate medium 5 to the color developing layer 9 on the surface layer 3 to be retransferred onto ordinary paper 21 at a rate of 10 mm/s with a pressing force of 300N and then fixed on the ordinary paper 21 by the heat (120° C.) of the heat roll 22 covered by silicone rubber layer, and a recorded pictorial image was thus obtained. The pictorial image thus recorded on ordinary paper had a maximum density of no less than 1.5 and there was no significant operating noise.

EXAMPLE 2

Preparation of transfer sheet

PET 200 mm wide and 4.5 μm thick was used as transfer substrate and on one side thereof a heat-resisting and slipping layer 1 μm thick (as in Example 1) was disposed. On the other side a patterned release layer 200 mm wide, 280 mm long and 0.3 μm thick was disposed. On top thereof, a patterned color developing layer 9 180 mm wide, 260 mm long and 2.5 μm thick was disposed and further thereon a patterned high polymer (macromolecular substance) layer 30 2.0 μm thick of a resin higher in glass transition temperature (Tg) than the binder resin of the color developing layer 9 previously formed was set for preparation of the transfer sheet 26 of 2-layer composition as shown in FIG. 10(E), whose surface shape was as shown in FIG. 10(D). The materials of the anchor layer 42 and the dye layer 13–15 were same as in anchor layer 42. The mark 43 for position matching was disposed in front of each patterned color developing layer.

| (Release layer coating) | |
|---|---|
| Silicone rubber (LTC350G: Toray Dowcorning Silicone, Ltd.) | 10 wt. parts |
| Catalyst (SRX212: Toray Dowcorning Silicone, Ltd.) | 0.1 wt. parts |
| Toluene | 30 wt. parts |
| (Color developing layer coating) | |
| Polyvinyl butyral resin (BL-S, Tg = 54° C.: Sekisui Chemical Industry Co. Ltd.) | 4 wt. parts |
| Siloxane-containing acryl silicone resin solution (F6A, effective ingredient 54 wt. %: Sanyo Kasei Kogyo, Ltd.) | 0.08 wt. parts |
| Di-n-butyl(me)dilaurate | 0.001 wt. parts |
| Toluene | 10 wt. parts |
| 2-butanone | 10 wt. parts |
| (High polymer (macromolecular) substance layer coating) | |
| Acetoacetalized polyvinyl alcohol (KS-10, Tg = 110° C.: Sekisui Chemical Industry Co., Ltd.) | 4 wt. parts |
| Toluene | 10 wt. parts |
| 2-Butanone | 10 wt. parts |

Preparation of intermediate medium

Polyimide film 250 mm wide, 314 mm long and 50 μm thick was used as intermediate medium substrate and a layer of fluorine rubber 400 μm thick was formed and cured for no less than 8 hours at 200° C. to prepare an intermediate medium. A mark for position matching was set on the fluorine rubber.

| (Surface layer) | |
|---|---|
| Fluorine contained rubber (E430: Showa Denko DuPont, Ltd.) | 7 wt. parts |
| Fluorine contained rubber (LM: Showa Denko DuPont, Ltd.) | 3 wt. parts |
| Magnesium oxide (Kyowamag 30: Kyowa Chemical Industrial Co., Ltd.) | 1.5 wt. parts |
| Polyol vulcanizing agent | 0.3 wt. parts |

The transfer sheet 26 prepared was set in the equipment of FIGS. 7(A) and (B) and recording was made on ordinary paper 21. The recording conditions are same as in Example 1. The transfer conditions are 160° C., pressing force 300N and transfer speed (rate) 10 mm/s. The pictorial image thus recorded was quite fine on ordinary paper, the maximum density was no less than 1.5 and there was no significant operating noise.

EXAMPLE 3

Preparation of intermediate medium

Endless belt of polyimide 120 mm wide, 190 mm in peripheral length and 50 μm thick was used as intermediate transfer substrate 4 and on one side thereof a fluorine rubber layer 30 μm thick (glossiness=35, rubber hardness 74°:25° C.) was formed and by curled for no less than 8 hours at 200° C. an intermediate medium as shown in FIGS. 11(A)–(D) was prepared. Marks were set on the fluorine contained rubber for position matching.

| (Surface layer coating) | |
|---|---|
| Fluorine contained rubber (Bitone B: Showa Denko DuPont, Ltd.) | 10 wt. parts |
| FT carbon | 2 wt. parts |
| Magnesium oxide (Starmag L: Kamishima Kagaku, Ltd.) | 1.5 wt. parts |
| Polyamine vulcanizing agent | 0.3 wt. parts |
| Methyl isobutylketone | 20 wt. parts |

Preparation of transfer sheet

PET 92 mm wide and 4.5 μm thick was used as transfer substrate 24 and on one side thereof a heat-resisting and slipping layer 1 μm thick (as in Example 1) was disposed. On the other side a patterned release layer 25 92 mm wide, 120 mm long and 0.3 μm thick was disposed. On top thereof a patterned color developing layer 9 80 mm wide, 110 mm long and 2.5 μm thick was disposed and further thereon a patterned high polymer (macomolecular substance) layer 30 2.0 μm thick of a resin higher in glass transition temperature (Tg) than the binder resin of the color developing layer 9 was and the transfer sheet 30 of essentially the same composition as in Example 2 was prepared. This intermediate substrate 5 was set in the equipment shown in FIGS. 8(A) and (B) and recording was done on postal cards. The conditions under which a color developing layer was formed on the intermediate medium were as follows.

| | |
|---|---|
| Recording speed | 16.8 ms/line |
| Recording pulse width | 8 ms |
| Recording energy | 8.6 J/cm$^2$ |
| Thermal head pressing force | 20 N |

The recording conditions were:

| | |
|---|---|
| Recorded pictorial image | 16 gradations |
| Recording speed | 16.8 ms/line |
| Recording pulse width | 0–8 ms |
| Maximum recording energy | 8.6 J/cm$^2$ |
| Thermal head pressing force | 20 N |

The conditions of transfer to ordinary paper of the color developing layer 9 were 160° C., 150N in pressing force and 10 mm/s in transfer speed.

The result showed that the operating noise was insignificant (quiet), the recorded pictorial image was very fine and even on post cards and the recording density was no less than 1.5. No problem occurred when test printing was carried out 10,000 cycles.

EXAMPLE 4

Preparation of intermediate medium

Endless belt of polyimide 120 mm wide, 190 mm in peripheral length and 50 $\mu$m thick was used as intermediate transfer substrate 4 and on it a surface layer of fluorine contained rubber (rubber hardness 43°:25° C.) 50 $\mu$m thick was formed and a topmost layer of fluorine rubber 5 $\mu$m thick (glossiness=35, rubber hardness 74°:25° C.) was formed and by cured for no less than 8 hours at 200° C. an intermediate medium as shown in FIG. 11(D) was prepared. Marks were set on the fluorine contained rubber for position matching.

| | |
|---|---|
| (Topmost layer coating) | |
| Fluorine contained rubber (Bitone B: Showa Denko DuPont, Ltd.) | 10 wt. parts |
| FT carbon | 2 wt. parts |
| Magnesium oxide (Starmag L, Kamishima Kagaku, Ltd.) | 1.5 wt. parts |
| Polyamine vulcanizing agent | 0.3 wt. parts |
| Methyl isobutylketone | 20 wt. parts |
| (Surface layer coating) | |
| Fluorine contained rubber (E430, Showa Denko DuPont, Ltd.) | 7 wt. parts |
| Fluorine contained rubber (LM, Showa Denko DuPont, Ltd.) | 3 wt. parts |
| Magnesium oxide (Kyowamag 30: Kyowa Kagaku Kogyo, Ltd.) | 1.5 wt. parts |
| Polyol vulcanizing agent | 0.3 wt. parts |
| Methyl isobutylketone | 20 wt. parts |

The aforementioned intermediate medium 5 was set in the equipment shown in FIGS. 8(A) and (B) and recording was made on postal cards. The conditions of forming the transfer sheets and operating conditions were all the same as in Example 3. The result showed that there was no particular operation noise, the pictorial image recorded on postal cards was fine and the maximum image density was no less than 1.5. No problem occurred in 10,000 cycles of test printing.

The invention may be embodied in other specific forms without departing from the spirit or essential characteristics thereof.

The above embodiments are to be considered in all respects as illustrative and not restrictive, the scope of the invention being indicated by the appended claims rather than by the foregoing description and all changes which come within the meaning and range of equivalency of the claims are intended to be embraced therein.

The embodiments described above are for the purpose of illustration and should not be considered to limit the scope of the invention in any way.

What is claimed is:

1. A thermal transfer printing method comprising:

(a) a color developing layer transfer process which comprises:

(i) providing a color developing layer transfer sheet having at least one color developing layer including a binder resin on a surface of a substrate, said binder resin having a flow softening point, and said substrate exhibiting an increasing force of adhesion to said color developing layer with increasing temperature, (ii) applying pressure to said color developing layer to apply said color developing layer to a surface layer of an intermediate medium, said surface layer exhibiting an decreasing force of adhesion to said color developing layer with increasing temperature, (iii) heating said color developing layer to a temperature not less than the flow softening point of the color developing layer binder resin, (iv) cooling said color developing layer to a temperature not greater than the point of intersection between a temperature-dependent variation curve of the adhesive force between said color developing layer substrate and said color developing layer and a temperature-dependent variation curve of the adhesive force between said color developing layer and said intermediate medium, and (v) separating said substrate of said color developing layer transfer sheet from said surface layer of said intermediate medium in order to transfer said color developing layer from said substrate of said color developing layer transfer sheet to said surface layer of said intermediate medium, (b) a recording process which comprises:

(i) providing a dye layer transfer sheet having at least a dye layer including a binder resin having a flow softening point, on a surface of a substrate, (ii) applying pressure to said dye layer to apply said dye layer to said color developing layer on said surface layer of said intermediate medium, (iii) heating said dye layer to a temperature not less than the flow softening point of the dye layer binder resin so as to form a recorded image by transferrng dyes from said dye layer to said color developing layer on said surface layer of said intermediate medium means, (iv) cooling said dye layer and color developing layer to a temperature not greater than either of the flow softening point of the binder resin of said dye layer or the flow softening point of the binder resin of said color developing layer, and (v) separating said substrate of said dye layer transfer sheet from said surface layer of said intermediate medium; and (c) a transfer process which comprises (i) heat-transferring said color developing layer having said recorded image formed thereon on the surface of said surface layer of said intermediate medium means to a color receiving sheet and (ii) separating said color receiving sheet from said surface layer of said intermediate medium.

2. A thermal transfer printing method according to claim 1, wherein said intermediate medium comprises at least a surface layer and an intermediate transfer substrate and said surface layer has a thickness more than 10 $\mu$m.

3. A thermal transfer printing method according to claim 2, wherein said surface layer of said intermediate medium comprises a fluorine containing rubber.

4. A thermal transfer printing method according to claim 3, wherein said intermediate medium means is made by coating a solution of said fluorine containing rubber in a ketone-type solvent on a substrate.

5. A thermal transfer printing method according to claim 4, wherein the intermediate medium is made from a fluorine contained rubber solution dissolved in a ketone-type solvent at no less than 100° C. in boiling point.

6. A thermal transfer printing method according to claim 5, wherein the intermediate medium is made from a fluorine contained rubber solution dissolved in 4-methyl-2-pentanone.

7. A thermal transfer printing method according to claim 3, wherein the intermediate medium is made by coating a polyolvulcanized fluorine contained rubber solution on a substrate.

8. A thermal transfer printing method according to claim 7, wherein said surface layer is made of a fluorine containing rubber having a Mooney viscosity of no more than 50.

9. A thermal transfer printing method according to claim 3, wherein said surface layer is made of at least fine particles comprising magnesium oxide and a fluorine containing rubber and has a glossiness of no more than 45.

10. A thermal transfer printing method according to claim 1, wherein the intermediate medium includes a surface layer, and an adhesive force between said surface layer and said color developing layer is not less than 5 g/inch when the temperature of said surface layer is 0° to 70° C. and the adhesive force between said surface layer and said color developing layer transfer sheet and between said surface layer and said dye layer transfer sheet is no more than 100 g/inch when the temperature is 0° to 70° C. and the adhesive force between said surface layer and said color developing layer is no more than 50 g/inch in said step of separating said color receiving sheet from said surface layer.

11. A thermal transfer printing method according to claim 1, wherein said intermediate medium includes a surface layer having concavo-convex surface roughness and a glossiness of no more than 45.

12. A thermal transfer printing method according to claim 1, wherein the intermediate medium has a surface layer comprising not less than 2 layers, and a topmost layer of the intermediate medium has a rubber hardness higher than that of lower layers, the topmost layer having a rubber hardness of over 70° at 25° C.

13. A thermal transfer printing method according to claim 12, wherein said surface layer of said intermediate medium comprises a fluorine containing rubber.

14. A thermal transfer printing method according to claim 13, wherein said topmost layer of said intermediate medium is made of a fluorine containing rubber having a Mooney viscosity of no more than 50.

15. A thermal transfer printing method according to claim 1, wherein said color developing layer transfer sheet further comprises a release layer having a size that is larger than the size of said color developing layer and said color developing layer transfer process (a) comprises heating a domain that is larger than the size of the color developing layer but smaller than the size of the release layer.

16. A thermal transfer printing method according to claim 15, wherein the intermediate medium includes a surface layer and the method further comprises separating said color developing layer transfer sheet from said surface layer where said release layer is in contact with said surface layer.

17. A thermal transfer printing method according to claim 1, wherein said color developing layer transfer sheet has a width which is the same as that of said release layer.

18. A thermal transfer printing method according to claim 1, wherein said color developing layer transfer sheet has a width which is the same as that of said color developing layer.

19. A thermal transfer printing method according to claim 1, wherein said dye layer has a size not greater than the size of said color developing layer.

20. A thermal transfer printing method according to claim 1, wherein said dye layer transfer sheet has a width no more than the width of said color developing layer.

21. A thermal transfer printing method according to claim 1, wherein said color developing layer transfer sheet further comprises a heat-resisting and slipping layer comprising at least a liquid lubricant and a resin wherein said liquid lubricant is a side-chain polyether-modified silicone oil.

22. A thermal transfer printing method according to claim 1, wherein the color developing layer transfer sheet further comprises a heat-resisting and slipping layer comprising a liquid lubricant and a resin wherein said liquid lubricant is a side-chain polyether-modified silicone oil and said resin is an epoxy resin photo-cured with oligoacrylate salt, aromatic iodonium salt or aromatic sulphonium salt as a catalyst.

23. A thermal transfer printing method according to claim 1, wherein the intermediate medium has an endless belt form.

24. A thermal transfer printing method according to claim 1, further comprising heating said color developing layer after transferring said color developing layer onto said color receiving sheet.

* * * * *